US012790163B2

(12) United States Patent
Kodaira et al.

(10) Patent No.: US 12,790,163 B2
(45) **Date of Patent: *Nov. 10, 2026**

(54) RECORDING DEVICE

(71) Applicant: SEIKO EPSON CORPORATION, Tokyo (JP)

(72) Inventors: Hirohisa Kodaira, Matsumoto (JP); Masaki Miyazawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 19/194,996

(22) Filed: Apr. 30, 2025

(65) Prior Publication Data

US 2025/0256940 A1 Aug. 14, 2025

Related U.S. Application Data

(63) Continuation of application No. 18/355,149, filed on Jul. 19, 2023, now Pat. No. 12,312,210.

(30) Foreign Application Priority Data

Jul. 22, 2022 (JP) ..... 2022-117022

(51) Int. Cl.
*B65H 83/02* (2006.01)
*B65H 1/04* (2006.01)
(Continued)

(52) U.S. Cl.
CPC ..... *B65H 83/025* (2013.01); *B65H 1/04* (2013.01); *B65H 1/266* (2013.01); *B65H 15/004* (2020.08); *B65H 85/00* (2013.01); *B65H 2301/132* (2013.01); *B65H 2301/1321* (2013.01); *B65H 2301/133* (2013.01); *B65H 2301/42254* (2013.01); *B65H 2301/424* (2013.01); *B65H 2301/43822* (2013.01); *B65H 2301/4482* (2013.01); *B65H 2403/411* (2013.01);
(Continued)

(58) Field of Classification Search
CPC ..... B65H 2405/324; B65H 2407/21; B65H 2601/322; B65H 31/24; B65H 1/30; B65H 2301/42134; B65H 83/025; B65H 85/00; B65H 29/58–64; B65H 9/101; B65H 2405/1142; B65H 2511/12; B65H 7/02; B65H 7/06; G03G 15/6514; G03G 2215/00392
USPC ..... 271/9.09, 3.01; 399/392
See application file for complete search history.

(56) References Cited

U.S. PATENT DOCUMENTS

| | | | | |
|---|---|---|---|---|
| 7,347,637 | B2 * | 3/2008 | Kubo | B65H 3/44 399/381 |
| 7,515,866 | B2 * | 4/2009 | Togashi | B65H 5/36 399/361 |
| 12,312,210 | B2 * | 5/2025 | Kodaira | B65H 1/04 |

FOREIGN PATENT DOCUMENTS

JP 2020-120449 A 8/2020

* cited by examiner

*Primary Examiner* — Jeremy R Severson
(74) *Attorney, Agent, or Firm* — WORKMAN NYDEGGER

(57) ABSTRACT

A recording device includes a device main body 20 including a recording section; a placement tray on which a medium M is configured to be placed; and a cassette provided below the recording section and the placement tray and configured to accommodate a medium M. The device main body includes a first path configured to feed medium M placed on the placement tray to the recording section and further to
(Continued)

transport the recorded medium and a second path configured to transport medium placed on the placement tray to the cassette.

9 Claims, 12 Drawing Sheets

(51) Int. Cl.
*B65H 1/26* (2006.01)
*B65H 15/00* (2006.01)
*B65H 85/00* (2006.01)

(52) U.S. Cl.
CPC .. *B65H 2405/324* (2013.01); *B65H 2405/332* (2013.01); *B65H 2407/21* (2013.01); *B65H 2511/10* (2013.01); *B65H 2551/20* (2013.01); *B65H 2801/03* (2013.01); *B65H 2801/06* (2013.01)

RD

| CASSETTE | MEDIUM TYPE |
|---|---|
| FIRST CASSETTE 22A | PLAIN PAPER B5 |
| SECOND CASSETTE 22B | PLAIN PAPER A4 |
| THIRD CASSETTE 22C | PAPER PRINTED ON ONE SIDE A4 |
| FOURTH CASSETTE 22D | PLAIN PAPER A3 |

RECORDING DEVICE

The present application is a continuation of U.S. application Ser. No. 18/355,149, filed Jul. 19, 2023, which is based on, and claims priority from JP Application Serial Number 2022-117022, filed Jul. 22, 2022, the disclosures of which are hereby incorporated by reference herein in their entirety.

BACKGROUND

1. Technical Field

The present disclosure relates to a recording device including a cassette that accommodates a medium such as paper and a recording section that performs recording on the medium fed from the cassette.

2. Related Art

For example, JP-A-2020-120449 discloses a recording device including a cassette (medium accommodation section) that accommodates a medium such as paper and a recording section that performs recording on the medium fed from the cassette. In this type of recording device, when medium in the cassette is consumed, a user performs a refill operation to refill the cassette with medium. In a case where medium of a size desired to be printed is not accommodated in the cassette, the user performs an exchange operation of exchanging the medium accommodated in the cassette with a medium of a different size. Since the recording device including a plurality of cassettes stores setting information that associates the cassette with a size of the medium, and the medium is fed from the cassette corresponding to the size designated by the user at a time of printing, the user does not need to designate the cassette each time printing is performed.

However, in the related art recording device, there is a possibility that the user erroneously sets a different size medium in the cassette. In this case, printing is performed on the wrong size medium. In recent years, there are cases in which printing is performed using paper printed on one side on which printing has been performed only on one side in consideration of the environment and the like. In this case, there is a possibility that front and back sides may be mistaken for each other when the paper printed on one side is stored in the cassette. In this case, printing may be erroneously performed on a printed surface of the paper printed on one side. When the paper printed on one side is placed in the cassette, there is a case where medium printed on both sides is mixed, and also in this case, printing may be erroneously performed on the printed surface. As described above, when the user refills or exchanges the medium in the cassette, a mistake in front and rear orientation, double-sided printed medium mixed in with the paper printed on one side, medium with defects in the paper printed on one side, or a mistake in the size of the medium that should be in the cassette become major causes of an increase in useless printing.

In a large-sized recording device such as an office printer, the cassettes are usually arranged at a height lower than waist height of the user. Therefore, it is necessary for the user to perform the refill operation or the exchange operation for the cassette, which is performed by holding a relatively heavy medium bundle, in a bent posture. As a result, the refill operation and the exchange operation of the medium for the cassette are a heavy work burden for the user.

SUMMARY

A recording device that solves the above-described problem includes a device main body including a recording section; a placement tray configured to support a medium; and a cassette provided below the recording section and the placement tray and configured to accommodate a medium, wherein the device main body includes a first path configured to feed medium placed on the placement tray to the recording section and further to transport the recorded medium and a second path configured to transport medium placed on the placement tray to the cassette.

DESCRIPTION OF EMBODIMENTS

Configuration of Recording Device 11

Figure 1:
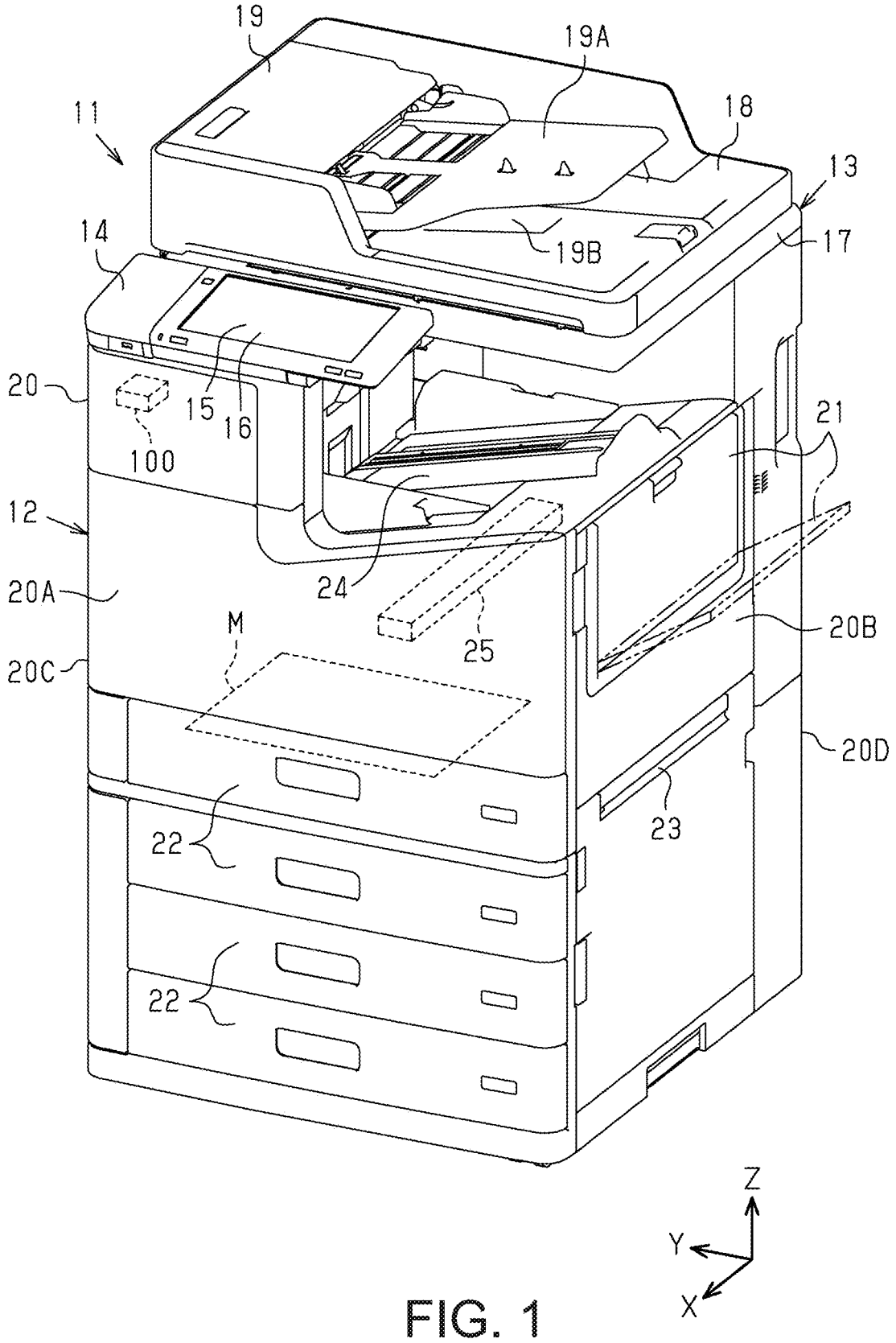
FIG. 1 is a perspective view showing a recording device according to an embodiment.

Hereinafter, an embodiment of a recording device will be described with reference to the drawings. In the drawings, it is assumed that a recording device 11 is placed on a horizontal installation surface. An axis orthogonal to the installation surface of the recording device 11 is defined as a Z-axis, and two axes orthogonal to the Z-axis are defined as an X-axis and a Y-axis, respectively. Directions parallel to the X-axis, the Y-axis, and the Z-axis are referred to as an X-axis direction, a Y-axis direction, and a Z-axis direction, respectively. The X-axis direction includes both a +X direction and a −X direction. The Y-axis direction includes both a +Y direction and a −Y direction. The Z-axis direction includes both a +Z direction and a −Z direction. The Z-axis direction, which is parallel to the Z-axis, is also referred to as a vertical direction Z. The X-axis direction is also referred to as a width direction X since it is the width direction of the medium M transported by the recording device 11.

As shown in FIG. 1, the recording device 11 includes a device main body 20 including a recording section 25, a placement tray 21 on which the medium M such as paper can be placed, and cassettes 22 that are provided below the recording section 25 and that accommodate the medium M.

As shown in FIG. 1, the recording device 11 is, for example, a multifunction device. The device main body 20 is a printer section 12, and a scanner section 13 is arranged on an upper section of the device main body 20. The recording device 11 may include an operation panel 14 on an upper section of the device main body 20. The operation panel 14 is provided in the device main body 20 at a height and a position at which a user can easily see and operate the operation panel 14.

The operation panel 14 includes a display section 15. The display section 15 may be a touch panel. In this case, an operation section 16 may be configured by a touch panel function of the display section 15. The user gives various instructions to the recording device 11 by operating the operation section 16. Various instructions may include instructions for recording, instructions for scanning, instructions for copying, and the like. The operation section 16 may be an operation switch formed of a mechanical switch.

The device main body 20 has, for example, a rectangular parallelepiped shape. The device main body 20 has a front surface 20A, two side surfaces 20B, 20C, and a back surface 20D. A stacker section 24 is arranged at a bottom of a recess between the device main body 20 and the scanner section 13. The front surface 20A is a surface on which the operation panel 14 is arranged in the device main body 20. In a state where the user stands facing the front surface 20A, the user performs an input operation for giving instructions to the recording device 11. In addition to accessing the operation panel 14, the user can access to place the medium M on the placement tray 21, to refill or exchange the medium M in the cassettes 22, and to take out the recorded medium from the stacker section 24, and the like from the front surface 20A side of the recording device 11.

The placement tray 21 is a tray on which the user places the medium M to be fed into the device main body 20. The placement tray 21 is also referred to as a sheet feeding tray. The medium before recording is placed on the placement tray 21 by the user. The placement tray 21 may be provided on a side section of the device main body 20 so as to be openable and closable. The placement tray 21 may be held in a posture inclined at a predetermined angle to the side section of the device main body 20. The placement tray 21 may have a multistage configuration in which a length can be changed according to a size of the medium M to be placed.

One or more cassettes 22 are provided. In other words, one or a plurality of cassettes 22 are provided. In an example shown in FIG. 1, a plurality of cassettes 22 are provided, but only one may be provided. In the example of FIG. 1, the plurality of cassettes 22 are provided in four stages, but may be provided in two stages, three stages, or five or more stages. A plurality of cassettes 22 may be added according to the user's needs. For example, the number of stages may be two before an addition and three or four after the addition.

The cassettes 22 are configured to be attachable to and detachable from the device main body 20. In the example of FIG. 1, the cassettes 22 are configured to be attachable to and detachable from the front surface of the recording device 11, but may be configured to be attachable to and detachable from the side section of the device main body 20.

The cassettes 22 are capable of accommodating a plurality of sheets of medium M. The cassettes 22 are configured to be able to change what size of medium M can be accommodated. Therefore, a different type of medium M is accommodated in each cassettes 22. Here, the type of medium M includes types related to size and material. Types of sizes include A4 size, A3 size, B5 size, B4 size, postcard size, name card size, and the like. Examples of material include plain paper, photographic paper, matte paper, glossy paper, OHP sheets, and paper printed on one side (miscellaneous paper), and the like. Further, the type of the medium M may include a type related to thickness. For example, plain paper and the like may be divided into thick paper, thin paper, and the like according to the type of thickness. When the type of medium M is distinguished by size and material, the former may be referred to as "size" and the latter may be referred to as "medium type" in this specification.

The recording device 11 transports the medium M placed on the placement tray 21 along a predetermined path provided in the device main body 20. The recording device 11 transports the medium M accommodated in the cassettes 22 along a predetermined path provided in the device main body 20. Each of the predetermined paths is formed in a path passing through a recording position facing the recording section 25. Details of the predetermined paths through which the medium M is transported will be described later.

When the recording device 11 receives a recording instruction, the recording device 11 feeds the medium M from the cassette 22 that accommodates the medium M of an instructed type (size and material). Therefore, in the recording device 11, the type of the medium M accommodated in the cassette 22 is associated with the cassette 22. The cassette 22 may be configured to include a plurality of trays on which medium M of different sizes can be placed.

The recording device 11 shown in FIG. 1 may include a connection section 23 on one side section of the device main body 20, which can be connected to a medium supply device (not shown), which is an external device capable of supplying the medium M to the recording device 11. The connection section 23 serves as a supply port of the medium M supplied from the medium supply device. The medium supply device may be, for example, a large-capacity medium supply device including a large-capacity cassette capable of accommodating a larger number of sheets of medium M than the cassette 22.

The recording section 25 performs recording on the medium M in a process in which the medium M transported along the predetermined path from the placement tray 21 or the cassette 22 passes through the recording position. The recording section 25 performs recording on the medium M using a predetermined recording method. The recording method is, for example, inkjet, but may be another recording method such as electrophotographic, dot impact, or thermal recording. For example, the recording section 25 of an inkjet method includes a nozzle capable of ejecting liquid such as ink and an ejection driving element that generates a driving force for ejecting liquid droplets such as ink droplets from the nozzle. The ejection driving element is driven by any one of piezoelectric, electrostatic, bubble, or other method. The recording section 25 draws a character or an image on the medium M with ink dots formed on a surface of the medium M by ejecting liquid from nozzles toward the medium M.

As shown in FIG. 1, the scanner section 13 includes a scanner main body 17 including a document table (not shown) on its upper surface, and a document placement surface cover 18 provided to be openable and closable with respect to an upper surface of the scanner main body 17 (document placement glass surface). An automatic document feeding section 19 (auto document feeder (ADF)) is mounted on an upper section of the document placement surface cover 18.

The scanner section 13 has a reading section (not shown) that reads a document set on a document placement glass (not shown) that is exposed when the document placement surface cover 18 is opened. The automatic document feeding section 19 sequentially feeds a plurality of documents set on a document tray 19A one by one, and sequentially discharges the documents read by the reading section at an intermediate position of the feed path to a stack section 19B.

As shown in FIG. 1, the cassette 22 is provided so as to be insertable into and removable from the device main body 20 from the front surface 20A side. The placement tray 21 is provided so as to be openable and closable by pivoting around its lower end. The placement tray 21 is used in an open state shown by a two dot chain line in FIG. 1 (a solid line in FIG. 2), and the user places (sets) the medium M thereon. The placement tray 21 may be a manual feed tray on which only one medium M can be placed, or may be configured with a hopper function in which a plurality of sheets of medium can be set in a stacked state and the medium M can be automatically fed one by one.

As shown in FIG. 1, the recording device 11 includes a control section 100 that controls the recording device 11 in a device main body 20. The control section 100 performs control of the printer section 12 and the scanner section 13, and display control of the display section 15.

Configuration of Placement Tray 21 and Cassette 22 in Recording Device 11

Figure 2:
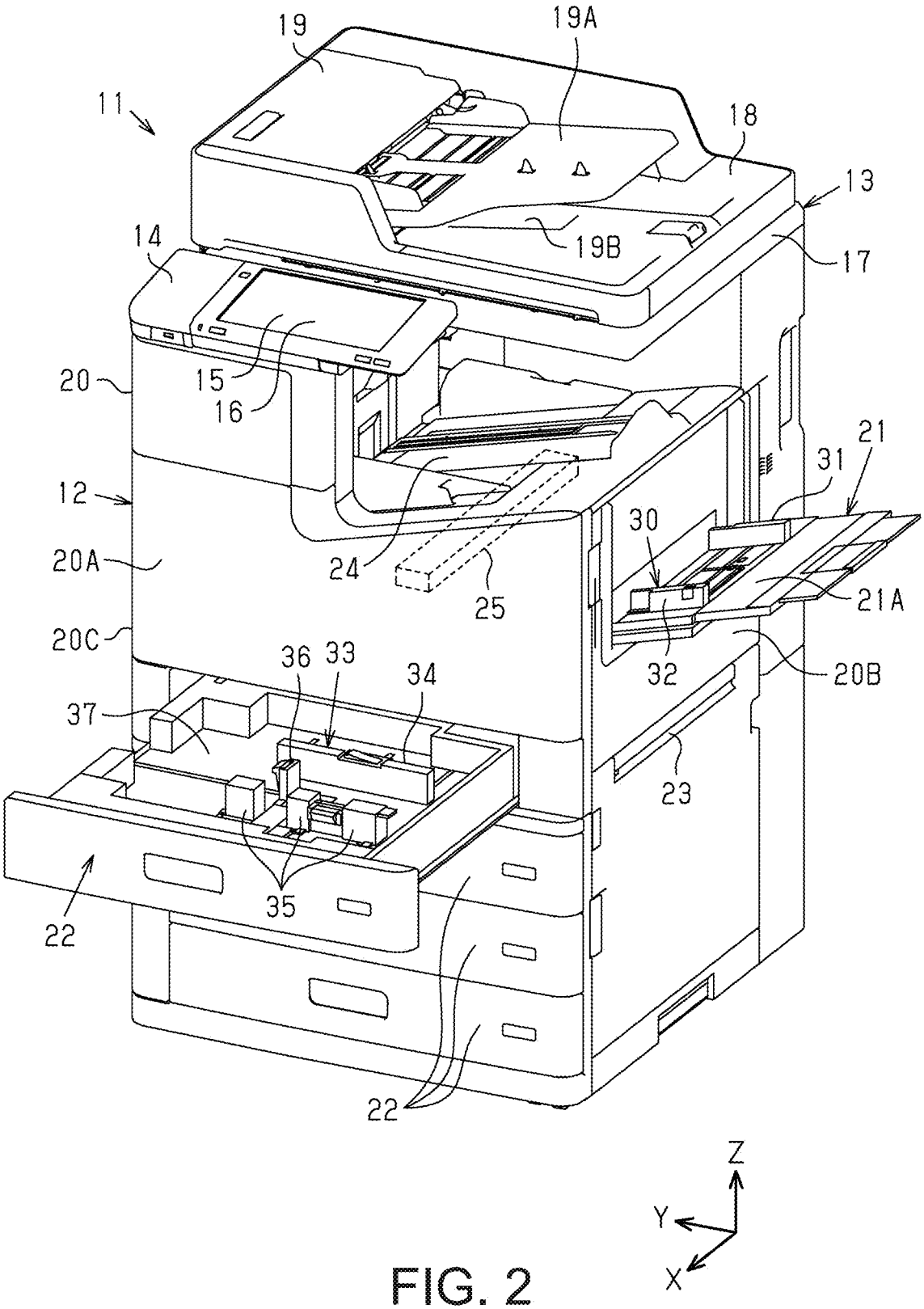
FIG. 2 is a perspective view showing the recording device in which a placement tray is in a use state and a cassette is in a drawer state.

FIG. 2 shows a state in which the placement tray 21 is arranged in its use state, and a state in which the cassette 22 is drawn out from the device main body 20. As shown in FIG. 2, the placement tray 21 includes a placement surface 21A on which the medium M can be placed, and a first positioning mechanism 30 that positions the medium M placed on the placement surface 21A in a width direction X. The first positioning mechanism 30 includes a pair of edge guides 31,32 capable of positioning the medium M in the width direction X. A first edge guide 31 and a second edge guide 32 are positioned so as to face each other in the width direction X, and are configured to be slidable so that the interval between them can be changed. A position of the medium M placed on the placement surface 21A in the width direction X is determined by the pair of edge guides 31,32.

As shown in FIG. 2, the cassette 22 has a substantially square box shape with an upper section open. The cassette 22 includes an accommodation recess capable of accommodating the medium M. The cassette 22 has a predetermined depth capable of accommodating a predetermined number of medium M in a stacked state. A second positioning mechanism 33 is mounted in the cassette 22. The second positioning mechanism 33 includes a pair of edge guides 34, 35 capable of positioning the medium M accommodated in the cassette 22 in the width direction X. A first edge guide 34 and a second edge guide 35 are positioned so as to face each other in the width direction X, and are configured to be slidable so that a facing interval can be changed. The second positioning mechanism 33 includes a third edge guide 36 that positions the medium M in the cassette 22 in a direction intersecting the width direction X as a feeding direction. When the third edge guide 36 comes into contact with a rear end of a medium bundle, the medium bundle is positioned at a position close to a downstream end side in the feeding direction in the cassette 22.

Internal Configuration of Printer Section 12

Next, detailed configuration of the printer section 12 will be described with reference to FIG. 3.

Figure 3:
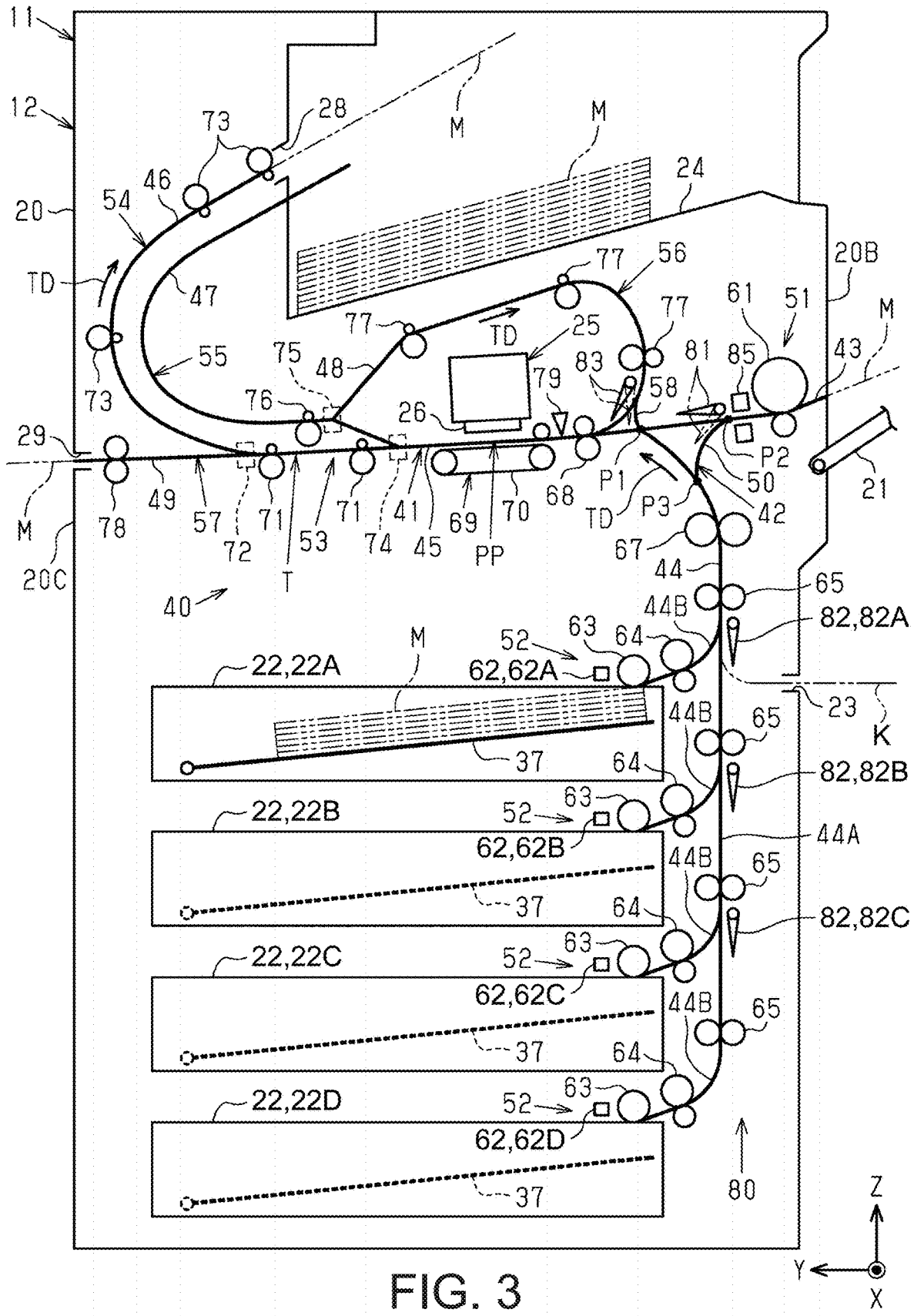
FIG. 3 is a schematic cross-sectional view showing internal configuration of a printer section of the recording device.

As shown in FIG. 3, the printer section 12 includes a transport unit 40 that transports the medium M placed on the placement tray 21 or the medium M accommodated in the cassette 22. The transport unit 40 includes a transport path T that is a path on which the medium M is transported.

The recording section 25 faces the transport path T at a recording position PP in an intermediate part of the transport path T. The recording section 25 includes a recording head 26. The recording head 26 employs, for example, a line recording method. The recording head 26 is formed of an elongated line head in which a dimension in the width direction X orthogonal to a paper surface of FIG. 2 is slightly longer than a width dimension of the maximum width medium M. The recording head 26 simultaneously ejects ink droplets in a range across the width direction X with respect to the medium M being transported. A character, an image, or the like is recorded on the medium M by liquid such as ink ejected from the recording head 26 adhering to the medium M.

The recording device 11 of the present embodiment includes a medium sort function of sorting the medium M according to the type and transporting the medium M to the cassette 22, in addition to a print transport function of transporting the medium M placed on the placement tray 21 for printing. Therefore, the recording device 11 includes a first path 41 capable of transporting the medium M from the placement tray 21 to the recording section 25 and a second path 42 capable of transporting the medium M from the placement tray 21 to the cassette 22. The first path 41 and the second path 42 are included in the transport path T.

Transport Path T

The transport unit 40 shown in FIG. 3 transports the medium M along the transport path T (thick line in FIG. 3). The transport path T includes a first feed path 43, a second feed path 44, a transport path 45, a first discharge path 46, a switchback path 47, and an inversion path 48 as paths for transporting the medium M during printing. Further, the transport path T may include a second discharge path 49 separately from the first discharge path 46 as a path for discharging the recorded medium M.

The first feed path 43 is a path for feeding the medium M from the placement tray 21 toward the recording section 25. The second feed path 44 is a path for feeding from the cassette 22 toward the recording section 25. In the recording device 11 of the present example including the plurality of cassettes 22, the second feeding path 44 includes a common path 44A through which the medium M fed from the plurality of cassettes 22 commonly passes, and individual paths 44B from the cassettes 22 to the common path 44A. A plurality of individual paths 44B are connected to the common path 44A.

The transport path 45 is a path through which the medium M fed from the first feed path 43 or the second feed path 44 is transported in a path passing through the recording position PP. The transport path 45 is a path through which the medium M on which recording is performed by the recording section 25 is transported.

The first discharge path 46 is a path for discharging the recorded medium M to the stacker section 24.

The switchback path 47 is a part of a path for inverting the medium M that has been recorded on a first side (front side) during double-sided recording in which recording is performed on both sides of the medium M. The medium M enters the switchback path 47 from a front end and is introduced into the inversion path 48 from a rear end by a switchback transport.

The inversion path 48 is a path for inverting front and back sides of the medium M after a switchback. The medium M introduced into the inversion path 48 from the rear end by the switchback transport is transported along the inversion path 48 so that the front and back sides of the medium M are inverted. The medium M whose front and back sides have been inverted through the inversion path 48 is re-fed to the transport path 45. The inversion path 48 merges with the first feed path 43 at a position downstream of the merging position P1 in a transport direction Y.

The second discharge path 49 is a path for discharging the medium M after the recording to outside of the device main body 20. A supply path K to which the medium Mis supplied from the medium supply device via the connection section 23 is connected to the second feed path 44.

The first path 41 of the present embodiment is a path through which the medium M is transported for the recording. The first path 41 includes the first feed path 43 and the transport path 45. The first path 41 may include a first discharge path 46 that discharges the recorded medium M. Further, in a case of the recording device 11 including a double-sided recording function, the first path 41 may include the inversion path 48 that inverts the medium M in which recording on a first side is completed in an orientation in which a second side, which is a side on an opposite side to the first side, faces the recording section 25 at a time of double-sided recording in which the recording is performed on both sides of the medium M. In this case, the first path 41 may include the switchback path 47 and the inversion path 48. The first path 41 may include a second discharge path 49 separately from the first discharge path 46.

The second path 42 is a path for refilling the cassette 22 by transporting the medium M placed on the placement tray 21 to the cassette 22. In other words, the second path 42 is a path from the placement tray 21 to the cassette 22. The second path 42 may be partially common with the first path 41. The second path 42 may include at least a part of the first feed path 43. The second path 42 may include at least a part of the second feed path 44.

The second path 42 of the present embodiment may include a bypass path 50 that branches off from an intermediate position of the first feed path 43 and is connected to the second feed path 44. The bypass path 50 connects the first feed path 43 and the second feed path 44. The bypass path 50 branches off from the first feed path 43 at a branch position P2 in the intermediate position of the first feed path 43, and merges with the second feed path 44 at a connection position P3 at an intermediate position of the second feed path 44. The bypass path 50 connects the branch position P2 and the connection position P3. The second path 42 may include a part of the first feed path 43, a part of the second feed path 44, and the bypass path 50. As described above, the second path 42 is partially common to the first feed path 43 in that the second path 42 includes a part of the first feed path 43 and a part of the second feed path 44. The second path 42 may include a path that passes through the bypass path 50 and a path that does not pass through the bypass path 50. For example, a path from the placement tray 21 to the cassette 22 may be switched in accordance with the type of the medium M. In this case, the second path 42 may be switched between a path that passes through the bypass path 50 and a path that does not pass through the bypass path 50 in accordance with the type of the medium M.

For example, depending on the type of the medium M, it may be necessary to transport the medium M to the cassette 22 after inverting the medium M. In this case, when the path used for inverting the medium M at the time of the double-sided recording is used as a part of the second path 42, addition of a new path is not necessary. For the medium M of a type requiring inversion of the medium M, a path including the switchback path 47 and the inversion path 48 is defined as a second path 42 as a path that does not pass through the bypass path 50. In this case, the second path 42 includes the first feed path 43, the transport path 45, the switchback path 47, a part of the inversion path 48, and a part of the second feed path 44. In the example shown in FIG. 3, the second path 42 includes an auxiliary path 58 that functions as a bypass path connecting the inversion path 48 and the second feed path 44.

Detailed Configuration of Transport Unit 40

Next, a detailed configuration of the transport unit 40 will be described with reference to FIG. 3.

As shown in FIG. 3, the transport unit 40 includes a first feeding section 51, a second feeding section 52, a transport section 53, a first discharging section 54, a switchback section 55, a inversion section 56, and a second discharging section 57 as constituent elements that transport the medium M along the transport path T.

The first feeding section 51 includes a feed roller pair 61 that feeds a bundle of medium M placed on the placement tray 21 one by one along the first feeding path 43.

The second feeding section 52 feeds the medium M accommodated in the cassette 22 one by one toward the recording section 25 along the second feed path 44. The second feeding section 52 includes a feed roller 63 and a separation roller pair 64 that feed the medium M from the cassette 22 to the second feeding path 44. The feed roller 63 is, for example, a pickup roller. In vicinity of the cassette 22, a remaining amount detection section 62 configured to be capable of detecting a remaining amount of the medium M in the cassette 22 is provided for each cassette 22.

The feed roller 63 sends the uppermost one of sheets of the medium M among the medium bundle in the cassette 22 to the individual path 44B. The separation roller pair 64 separates the medium M fed to the individual path 44B by the feed roller 63 into one sheet. A plurality of (for example, four) transport roller pairs 65 are arranged along the common path 44A. The recording device 11 includes a heat roller 67 that heats the medium M at a position at an intermediate position of the second path 42. The heat roller 67 of the present embodiment is positioned on a downstream side of the four individual paths 44B in a transport direction TD in the second feed path 44. For example, the heat roller 67 may be positioned an upstream of the connection position P3 in the transport direction TD in the second feed path 44. The recording device 11 transports the medium M heated by the heat roller 67 to the cassette 22.

The transport section 53 transports the medium M fed from the first feeding section 51 or the second feeding section 52 along the transport path 45. The transport section 53 may include a transport roller pair 68. The transport roller pair 68 is arranged at a position slightly downstream in the transport direction TD from the merging position P1 of the first feed path 43 and the second feed path 44.

Skew of the medium M is corrected in a feeding process by abutting the front end of the medium M against the transport roller pair 68 which is stopped. The medium M after skew correction is transported to the transport path 45 by a rotation of the transport roller pair 68. Each feeding section 51, 52 has a function of delivering the medium M to the transport roller pair 68. Therefore, the feed paths 43, 44 extend to a nip position of the transport roller pair 68. A path on a downstream side of the nip position of the transport roller pair 68 in the transport direction TD is the transport path 45.

As shown in FIG. 3, the transport section 53 may include a belt transport mechanism 69 arranged at a position facing the recording head 26. The belt transport mechanism 69 includes an endless transport belt 70 wound around a pair of rollers. The belt transport mechanism 69 employs an electrostatic attraction type in which the medium M is attracted to a charged surface of the transport belt 70 by electrostatic force. The recording head 26 performs the recording on the medium M by ejecting liquid such as ink toward the medium M which is transported at a constant speed in a state in which a constant gap with the recording head 26 is maintained by the belt transport mechanism 69.

The first discharging section 54 transports the recorded medium M along the first discharge path 46. The second discharging section 57 discharges the recorded medium M from the first discharge port 28 to the stacker section 24.

The switchback section 55 performs switchback transport of the medium M along the switchback path 47. The switchback transport includes transport of the medium M toward a downstream in the transport direction TD and reverse transport of the medium M toward an upstream in the transport direction TD. The switchback path 47 is a path for performing switchback transport in which the medium M is reciprocated once in the transport direction TD and a reverse transport direction-TD. The switchback section 55 guides the medium M from the rear end to the inversion path 48 by performing switchback transport of the medium M having finished recording on the first side (front side).

The inversion section 56 inverts the front and back sides of the medium M by transporting the medium M after the switchback along the inversion path 48. The inversion path 48 merges with the first feed path 43 at a position on a downstream side of the branch position P2 in the transport direction Y. Therefore, the medium M whose front and back sides are inverted through the inversion path 48 is re-fed to the transport path 45. As described above, by the switchback section 55 and the inversion section 56, the medium M on which the first side has been recorded is re-fed to the recording position PP in an orientation in which the second side (back side), which is the side to be recorded on, faces the recording head 26.

The second discharging section 57 transports the recorded medium M along the second discharge path 49. The second discharging section 57 discharges the recorded medium M from a second discharge port 29 to the outside of the device main body 20.

Configuration of Sorting Mechanism 80

Next, with reference to FIG. 3, a configuration of a sorting mechanism 80 that sorts the medium M according to the type and transports the medium M to the cassette 22 will be described.

As shown in FIG. 3, the recording device 11 includes the second path 42 for refilling the cassettes 22 with medium M, and a sorting mechanism 80 for selecting a path of the second path 42 that will transport the medium M to the cassette 22 that corresponds to the information about the medium M. The recording device 11 includes a detection section 85 for detecting information on the medium M. The sorting mechanism 80 sorts the medium M to the cassettes 22 corresponding to the medium M information detected by the detection section 85.

The detection section 85 detects the information on the medium M at an intermediate position of the second path 42. The detection section 85 determines whether or not the medium M is a first medium on which neither side has been unrecorded (for example, blank paper) as information by detecting both front and back sides of the medium M. The recording device 11 may transport the medium M determined as the first medium by the detection section 85 to the cassette 22 via the bypass path 50.

The detection section 85 may determine, as information obtained by detecting both the front and back sides of the medium M, that a second medium has been recorded on only one side and needs to have the front and back sides inverted before being transported to the cassette 22. The recording device 11 inverts the medium M, which is determined to be the second medium by the detection section 85, in the inversion path 48 and then transports the medium M to the cassette 22.

The detection section 85 may detect defects of the medium M as the information. The recording device 11 may discharge the medium M in which the defects have been detected to the discharging sections 54, 57.

The discharging sections 54,57 may include the first discharging section 54 and the second discharging section 57 different from the first discharging section 54. The recording device 11 may discharge medium M with defects and non-corresponding medium M that has no cassette specified for its size separately to the first discharging section 54 and to the second discharging section 57. The first discharging section 54 may include a stacker section 24 provided in the device main body 20. The second discharging section 57 may include the second discharge port 29 capable of discharging the medium M out of the device main body 20. Non-corresponding medium M may be discharged to the stacker section 24, and medium M with defects may be discharged from the second discharge port 29 to a discard section provided outside the device main body 20. An example of the discard section is a shredder connected to the recording device 11 via the second discharge port 29. The discard section may be a discarding box or the like that collects medium M with defects by discharging it from the second discharge port 29.

The sorting mechanism 80 includes the bypass path 50 that branches off from an intermediate section of the first feed path 43 and that is connected to the second feed path 44, and a first flap 81 as an example of a flap that guides the medium M from the first feed path 43 to the bypass path 50.

The bypass path 50 branches off from the first feed path 43 at a branch position P2, which is upstream in the transport direction TD from the merging position P1. The branch position P2 is positioned between the merging position P1 and a nip position where the feed roller pair 61 nips the medium M.

The bypass path 50 is connected to the second feed path 44 at the connection position P3 positioned upstream of the merging position P1 in the transport direction TD. That is, the bypass path 50 is a path that connects the first feed path 43 and the second feed path 44 between the branch position P2 and the connection position P3.

The first flap 81 can guide the medium M to the bypass path 50 at the branch position P2 at an intermediate position of the first feed path 43. The first flap 81 is driven by power of an actuator such as a motor. When the control section 100 drives and controls the actuator, the first flap 81 pivots between a first position indicated by a solid line in FIG. 3 in which the first path 41 is selected as a path through which the medium M is transported and a second position indicated by a two dot chain line in FIG. 3 in which the bypass path 50 is selected. The first flap 81 switches the paths at the branch position P2. The first flap 81 may select one of the first path 41 and the second path 42 according to whether a transport of the medium M at that time is for a purpose of recording or for a purpose of transporting the medium M to the cassette 22. The medium M passing through the bypass path 50 is transported to the second feed path 44. The first flap 81 may be configured to select the second path 42 that does not pass through the bypass path 50 depending on the type of medium M even when the purpose is to transport the medium M to the cassette 22. In other words, even when the purpose is to transport the medium M to the cassette 22, depending on the type of medium M, the first flap 81 may be arranged at the first position to select the second path 42 that does not pass through the bypass path 50.

The sorting mechanism 80 of the present embodiment includes second flaps 82 that guide the medium M from the common path 44A to the individual paths 44B. The second flap 82 guides the medium M to the individual paths 44B to the cassette 22 specified in accordance with the type of the medium M. Since the recording device 11 of the present example includes four cassettes 22 as an example, it includes three second flaps 82 that sort the medium M to the four cassettes 22. Three second flaps 82 are, for example, a first sorting flap 82A, a second sorting flap 82B, and a third sorting flap 82C. The plurality of sorting flaps 82A to 82C are driven by power of actuators such as motors.

As shown in FIG. 3, the recording device 11 includes a detection section 85 that detects information regarding the medium M at a position at an intermediate position of the second path 42. The detection section 85 detects the medium M at a position upstream of the branch position P2 in the transport direction TD in the first feed path 43. The detection section 85 can detect the size of the medium M. The detection section 85 of the present embodiment detects the type of the medium M. Here, at least the size of the medium Mis detected as the type of the medium M. The type of the medium M may be configured such that the medium type can be detected in addition to the size. In a case where there is no cassette 22 specified from the size detected by the detection section 85, the medium M of the size is discharged to the first discharging section 54. In particular, in the present embodiment, medium M that has no cassette 22 associated with the size and the medium type detected by the detection section 85 in the setting data RD (refer to FIG. 5), as an example of the setting information, is discharged to the first discharging section 54.

As shown in FIG. 3, a medium sensor 79 is arranged at a position upstream of the recording head 26 in the transport direction TD. The medium sensor 79 is positioned between the recording section 25 and the transport roller pair 68. The medium sensor 79 detects the front end or the rear end in the transport direction TD of the medium M fed by the first feeding section 51 and the second feeding section 52. The control section 100 controls the transport position of the medium M based on a detection position at which the front end or the rear end of the medium M is detected. Then, the control section 100 controls a recording operation by the recording section 25 in accordance with the transport position of the medium M.

At the time of double-sided recording in which recording is performed on both sides of the medium M, the switchback section 55 and the inversion section 56 invert the front and back sides of the medium M on which recording on the first side (front side) which is one side is completed, and re-feed the medium M to the transport path 45. Specifically, the medium M for which the recording on the first side has been completed is guided to the switchback path 47 by the path switching mechanism 74. By performing switchback transport including transport in the transport direction TD and reverse transport in the reverse transport direction—TD along the switchback path 47, the medium M is guided from the rear end side to the inversion path 48 via the path switching mechanism 75. At this time, the transport roller pair 76 is rotated in the reverse direction after the forward rotation. The medium M is transported along the inversion path 48 by rotation of a plurality of inversion transport roller pairs 77. Accordingly, the medium M is transported into the transport path 45 again in a state in which a second side (back side) is inverted to be the record surface. The recording section 25 performs recording on the second side of the medium M. The medium M on which double-sided recording has been performed in this manner is discharged along the first discharge path 46 or the second discharge path 49. The recording device 11 of the present embodiment includes discharging sections 54, 57 at intermediate positions of the first path 41 for discharging the medium M recorded on by the recording section 25. The second discharge path 49 may be used as a discharge path for discarding the medium M with defects.

As shown in FIG. 3, path switching mechanisms 72, 74, 75 for switching to one path at a branch point are provided at a plurality of (for example, three) branch points positioned downstream of the recording position PP in the transport direction TD in the transport path T.

The transport unit 40 shown in FIG. 3 includes motors 121, 122, 123, 125 as an example of drive sources for rotationally driving roller pairs 61, 64, 65, 68, 71, 73, 76, 77, the feed roller 63, the heat roller 67, and the like. The first feed roller pair 61 is driven by power of a first feed motor 121 (refer to FIG. 6). The feed roller 63, the transport roller pair 65, and the heat roller 67 are driven by power of a second feed motor 122 (refer to FIG. 6). The transport roller pair 68, the discharge roller pair 71, and the transport roller pairs 76, 77 are driven by power of a first transport motor 123 (refer to FIG. 6). Further, the belt transport mechanism 69 shown in FIG. 3 is driven by power of a belt motor 124 (refer to FIG. 6). The discharge roller pair 73 of the first discharging section 54 and the discharge roller pair 78 of the second discharging section 57 shown in FIG. 3 are driven by power of the second transport motor 125 (refer to FIG. 6). The belt transport mechanism 69 shown in FIG. 3 is driven by power of the belt motor 124 (refer to FIG. 6).

Configuration of Second Positioning Mechanism of Cassette 22

Figures 4, 5:
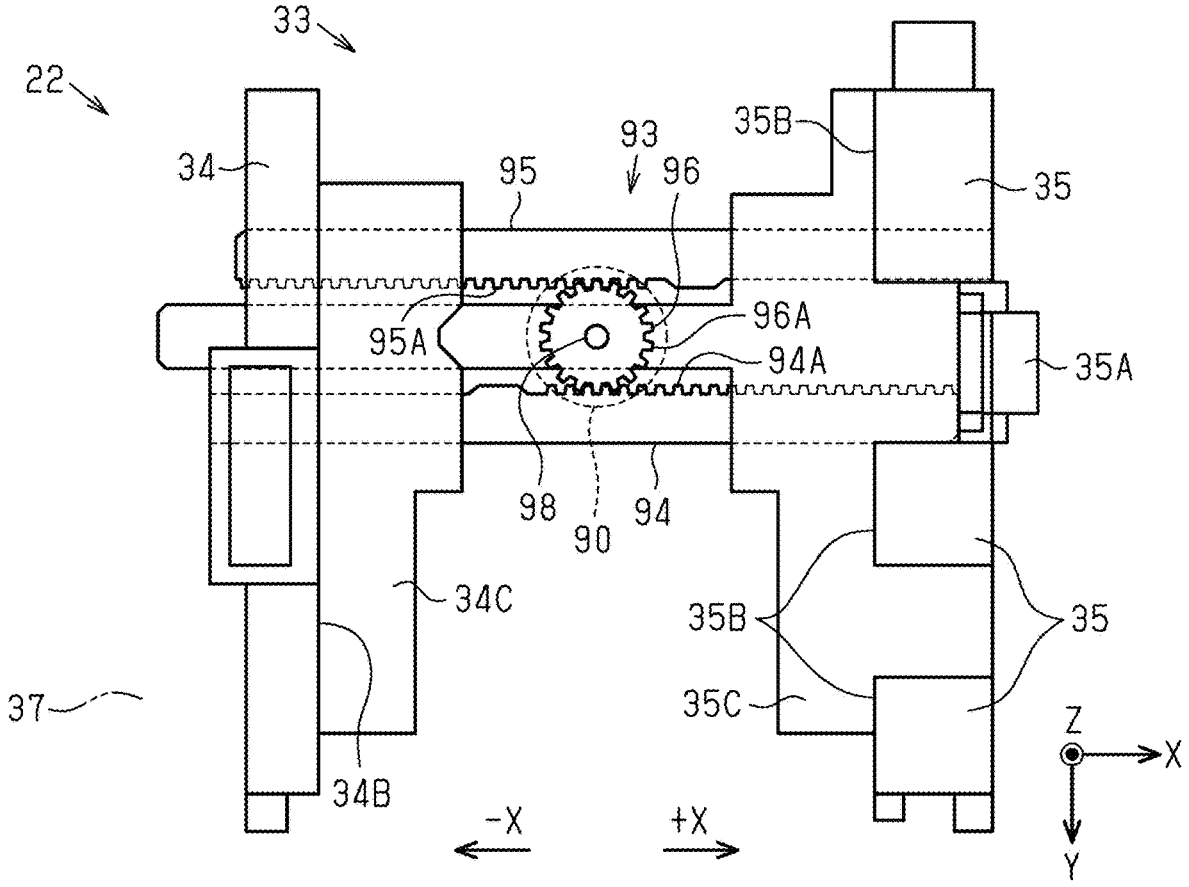
FIG. 4 is a schematic plan view showing a positioning mechanism in the cassette.
FIG. 5 is a schematic diagram showing setting data relating the cassette and a type of medium.

Next, the second positioning mechanism 33 of the cassette 22 will be described with reference to FIG. 4. In FIG. 4, the third edge guide 36 is omitted. As shown in FIG. 4, the second positioning mechanism 33 as an example of a positioning mechanism includes a pair of edge guides 34, 35 slidable in the width direction X. The pair of edge guides 34, 35 are configured to be able to approach and separate from each other by the same amount in the width direction X. The second edge guide 35 includes an operation section 35A. When the user operates the operation section 35A to release lock, the second edge guide 35 becomes movable, and thereafter, when the operation section 35A is released at the movement destination position, the second edge guide 35 is locked at that position.

A hopper 37 is arranged in a region where the medium M is placed in the cassette 22. The medium M that is positioned by the pair of edge guides 34, 35 is placed on the hopper 37. The hopper 37 has a predetermined shape (for example, an H-shape) which can be tilted without interfering with the edge guide 34, 35 and the like. In a state where the cassette 22 is attached to the device main body 20, the hopper 37 lifts the medium M and presses it against the feed roller 63 (refer to FIG. 3).

As shown in FIG. 4, the second positioning mechanism 33 includes a rack and pinion mechanism 93 that slides the pair of edge guides 34, 35 in conjunction with each other. The rack and pinion mechanism 93 includes a first rack 94, a second rack 95, and a pinion 96.

The first rack 94 is fixed to a bottom of the first edge guide 34, and extends in the width direction X toward the second edge guide 35. The second rack 95 is fixed to a bottom of the second edge guide 35, and extends in the width direction X toward the first edge guide 34. The first rack 94 and the second rack 95 includes gear sections 94A, 95A on their side surfaces facing each other. The pinion 96 is positioned at a width center between the first edge guide 34 and the second edge guide 35 in the width direction X, and is positioned between the first rack 94 and the second rack 95 in the transport direction Y. The gear section 96A of the pinion 96 meshes with both the gear section 94A of the first rack 94 and the gear section 95A of the second rack 95.

As shown in FIG. 4, the first edge guide 34 includes a first guide surface 34B that guides one side edge of the medium M. The second edge guide 35 includes a second guide surface 35B that guides the other side edge of the medium M. The first edge guide 34 includes a first bottom plate section 34C extending from its base section in the +X direction. The second edge guide 35 includes a second bottom plate section 35C extending from its base section in the −X direction. The pinion 96 is supported in a rotatable state about a shaft section 98 provided on a bottom plate section of the cassette 22.

As shown in FIG. 4, the second positioning mechanism 33 may include a guide motor 90 as a drive source that moves the pair of edge guides 34, 35, which are capable of positioning the medium M at least in the width direction X, in the positioning direction (width direction X). An aligning operation is performed in which the pair of edge guides 34, 35 hit side ends on both sides of a bundle of the medium M that was transported to a cassette 22.

The pinion 96 is configured to be capable of forward and reverse rotation by a power of a guide motor 90 via a gear mechanism (not shown). When the cassette 22 is attached to the device main body 20, the pinion 96 and the guide motor 90 are connected via the gear mechanism so as to be able to transmit the power. By the control section 100 driving the guide motor 90 in forward and reverse directions, it is possible to control the approach/separation position of the pair of edge guides 34, 35. For example, when the control section 100 drives the guide motor 90 in the forward direction, the pair of edge guides 34, 35 separate from each other, and when the guide motor 90 is driven in the reverse direction, the pair of edge guides 34, 35 approach each other. Thus, the pair of edge guides 34, 35 are automatically moved so that an interval between them can be changed. The control section 100 may drive and control the guide motor 90 to adjust the interval between the pair of edge guides 34, 35 to an interval corresponding to the size of the medium M. The control section 100 may perform the alignment operation of reducing a deviation of the bundle of the medium M in the width direction X by performing the drive control of the guide motor 90 and performing an operation of hitting the side edges on both sides of the bundle of the medium M by the pair of edge guides 34, 35.

Electrical Configuration of Recording Device 11

Next, an electrical configuration of the recording device 11 will be described with reference to FIG. 6.

The recording device 11 includes the control section 100. An operation section 16, a plurality of rotary encoders 86 to 89, a medium sensor 79, a detection section 85, first to fourth remaining amount detection sections 62A to 62D (62), and the like are electrically connected to the control section 100 as input systems. The control section 100 receives a print job PD from a host device 110 communicably connected to the recording device 11. The recording device 11 may generate the print job PD based on a print condition, print image data, and the like selected by the user using the operation section 16.

The print job PD includes various commands necessary for print control, print condition information designated by the user, and print image data. The control section 100 controls the various motors 121 to 125 and the like based on a print command and controls the recording head 26 based on the print image data to record a character or an image based on the print image data on the medium M. In a case where the recording head 26 is, for example, an inkjet type, the recording head 26 draws the character or the image on the medium M with liquid dots such as ink dots by ejecting liquid such as ink from nozzles based on the print image data.

A display section 15, a first feed motor 121, a second feed motor 122, a first transport motor 123, a belt motor 124, a second transport motor 125, which constitute the transport unit 40, and a recording section 25 are electrically connected to the control section 100 as output systems.

The control section 100 performs display control to display various menu screens on the display section 15. A control section (not shown) of the host device 110 can cause a display section 111 to display various menu screens similar to the display section 15. Since basic display contents of the menu screen and the like displayed on the display sections 15, 111 are the same, an example of the menu screen displayed on the display section 15 of the operation panel 14 will be described below.

Further, the first flap 81, the plurality of second flaps 82 and the third flap 83 constituting the sorting mechanism 80 are electrically connected to the control section 100 as output systems. The plurality of second flaps 82 correspond to the first to third sorting flaps 82A to 82C (refer to FIG. 3).

Figure 6:
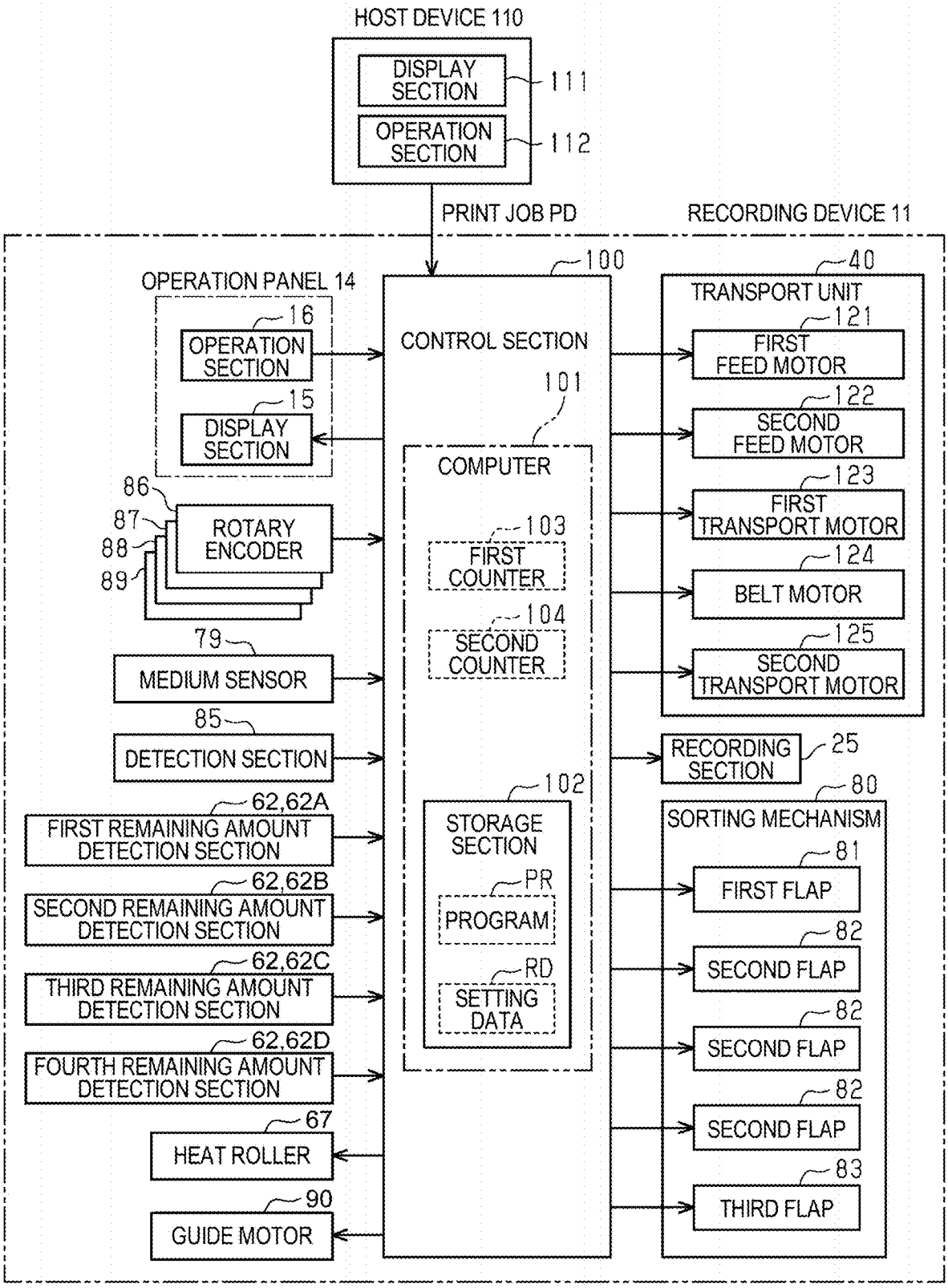
FIG. 6 is a block diagram showing an electrical configuration of the recording device.

The heat roller 67 and the guide motor 90 as output systems are electrically connected to the control section 100 shown in FIG. 6. The control section 100 heats the heat roller 67 to a set heating temperature by applying a set current value to a heater (not shown) built in the heat roller 67. The set heating temperature may be determined depending on the type of medium M. Here, a medium M having a thin thickness tends wrinkle more easily than a medium M having a thick thickness. The medium M recorded on one surface tends to have more wrinkles than the medium M not recorded on either side (for example, blank paper).

For example, in a case of a first medium having a first thickness, the control section 100 may set heating temperature of the heat roller 67 higher than that in a case of a second medium having a second thickness larger than the first thickness. For example, in a case of a second medium which is recorded on only one side, the control section 100 may set the heating temperature of the heat roller 67 higher than that in a case of a first medium which is not recorded on either side. Here, the first medium may be, for example, plain paper that is not recorded on either side, and the second medium may be, for example, paper printed on one side.

The recording device 11 may include a humidity detection section that detects humidity around the device. The control section 100 may change the heating temperature of the heat roller 67 according to a detection result of the humidity. For example, the control section 100 may set the heating temperature of the heat roller 67 to be higher at a first humidity than at a second humidity lower than the first humidity.

The control section 100 controls the positioning mechanism 33 in the cassette 22 by controlling the guide motor 90. The control section 100 controls the interval between at least the pair of edge guides 34, 35 by controlling the guide motor 90. The control section 100 may control the position of the third edge guide 36 by controlling a drive source such as a motor that moves the third edge guide 36.

The detection section 85 detects information related to the medium M fed from the placement tray 21 at least at a time of medium sort. The information on the medium M includes the type of the medium M. The type of medium M includes at least the size among the size and the medium type. The control section 100 specifies the cassette 22 to which the medium M is to be introduced based on the information relating to the medium M that was detected by the detection section 85. The detection section 85 may be, for example, an image sensor or an optical sensor of a light reflection type or a light transmission type. In a case where the detection section 85 is an image sensor, the control section 100 detects the type of the medium M by performing image processing or the like based on an image read by the detection section 85. The type of medium is specified by detecting, using an image layer process, a difference in texture due to a difference in the medium type. In a case where the detection section 85 is an optical sensor, the control section 100 detects the type of the medium M based on a detection signal from the optical sensor. For example, the size may be specified from a side end position of the medium M detected by the optical sensor. The medium type may be specified in accordance with an amount of light received by the optical sensor.

The control section 100 acquires information on the remaining amount of the medium M accommodated in the cassette 22 detected by the remaining amount detection section 62. In the present embodiment, the control section 100 acquires information on the remaining amount in each cassette 22 from the first to fourth remaining amount detection sections 62A to 62D that detect the remaining amount in each of the four cassettes 22. In a case where the remaining amount of the cassette 22 to be a transport destination specified from the setting data RD is equal to or greater than a threshold, the control section 100 does not transport the medium M from the placement tray 21 to the cassette 22. The threshold may be changed by the user operating the operation section 16.

The rotary encoders 86 to 89 detect rotation of each of the first feed motor 121, the second feed motor 122, the first transport motor 123, and the second transport motor 125. Each of the rotary encoders 86 to 89 outputs an encoder signal including a number of pulses proportional to rotation amount of the corresponding the motors 121 to 123, 125 whose rotation is to be detected to the control section 100.

The control section 100 also includes a computer 101. The computer 101 is configured to include a central processing unit (CPU), a read only memory (ROM), a random access memory (RAM) and a storage (none of which are shown). The control section 100 controls a transport of the medium M in the recording device 11 and a printing operation of information on the medium M by the recording section 25. Specifically, the control section 100 is not limited to performing software processing for all processing executed by the control section 100 itself. For example, the control section 100 may include a dedicated hardware circuit (for example, an application specific integrated circuit (ASIC)) that performs hardware processing for at least a part of processing executed by the control section 100 itself. That is, the control section 100 can be configured as circuitry including one or more processors that operate according to a computer program (software), one or more dedicated hardware circuits that execute at least a part of various processes, or a combination thereof. The processor includes a CPU and a storage section 102 such as a RAM and a ROM, and the storage section 102 stores a program code or a command configured to cause the CPU to execute a process. The storage section 102 or computer readable medium includes any available media that can be accessed by a general purpose or special purpose computer.

Figure 9:
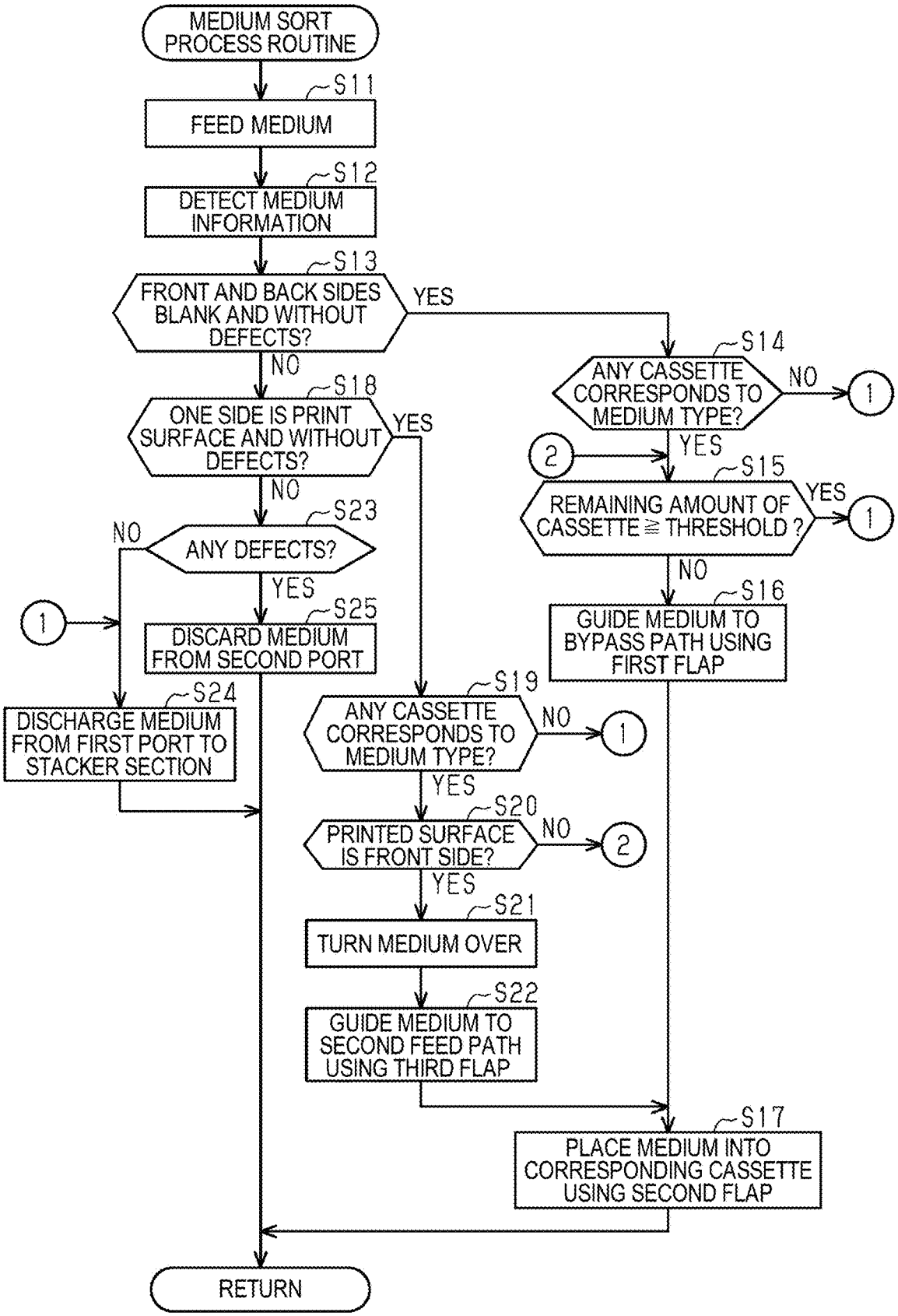
FIG. 9 is a flowchart showing a medium sort process routine.
Figure 10:
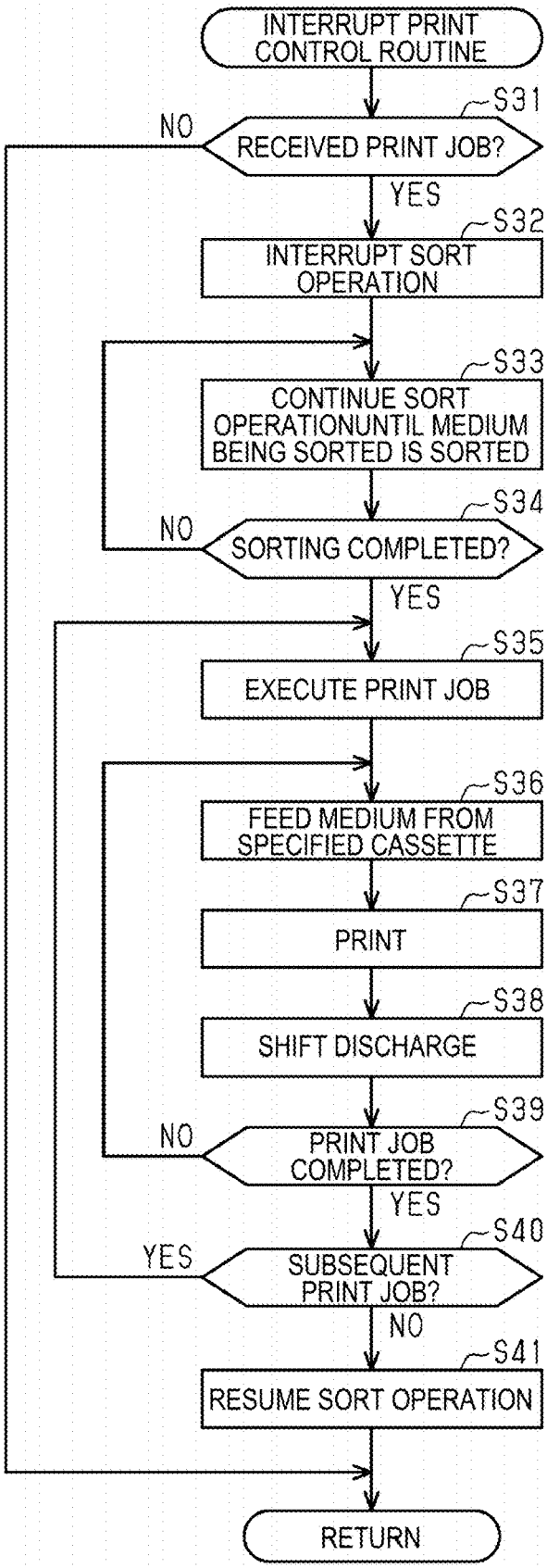
FIG. 10 is a flowchart showing an interrupt print control routine.

As shown in FIG. 6, the storage section 102 stores a program PR. The computer 101 executes the program PR to perform various kinds of control including a medium sort control shown in a flowcharts of FIGS. 9 and 10.

Further, the storage section 102 stores the setting data RD that associates the cassette 22 with the type of medium M to be accommodated in the cassette 22. The user operates the operation section 16 to perform a setting operation for associating the cassette 22 with the type of the medium M. This setting content is stored in the storage section 102 as the setting data RD. Here, the type of the medium M in the setting data RD includes the size and the medium type. The type of the medium M may include at least the size from among the size and the medium type.

At a time of printing (at a time of a print mode), the control section 100 specifies the cassette 22 corresponding to the type of the medium M by referring to the setting data RD based on information of the type of the medium M included in the print condition information. The control section 100 feeds the medium M from the specified cassette 22. Specifically, the control section 100 feeds the medium M from the cassette 22 by driving the second feed motor 122 corresponding to the specified cassette 22. In a case where the placement tray 21 is designated as the feed source by the print condition information, the control section 100 feeds the medium M placed on the placement tray 21.

The control section 100 specifies the cassette 22 to be the transport destination of the medium M by referring to the setting data RD based on the information of the type of the medium M detected by the detection section 85 at a time of medium sort (at a time of a medium sort mode). At this time, the information of the medium M used for specifying the cassette 22 may include at least the information of the size among the size and the medium type constituting the type of the medium M. The control section 100 transports the medium M to the specified cassette 22.

The computer 101 includes a first counter 103 and a second counter 104. The first counter 103 counts, for example, a number of pulse edges of encoder signals input from the rotary encoders 86 to 89 that detect the rotation of the motors 121 to 123, 125 of the transport system during printing. A count value of the first counter 103 indicates a transport position of the medium M transported from the placement tray 21 or the cassette 22 along the first path 41.

The second counter 104 counts, for example, a number of pulse edges of encoder signals input from the rotary encoders 86 to 89 that detect the rotation of the motors 121 to 123, 125 of the transport system. A count value of the second counter 104 indicates a transport position of the medium M transported from the placement tray 21 toward the cassette 22 along the second path 42.

At the time of printing, the control section 100 performs recording control of the recording section 25 and control of the path switching mechanism 72, 74, 75 (refer to FIG. 3) according to the transport position of the medium M obtained from the count value of the first counter 103. The counting start position of the first counter 103 is based on a time when the medium M reaches a predetermined position on the transport path T. For example, the first counter 103 may be reset when the medium sensor 79 detects the front end of the medium M. The first counter 103 and the second counter 104 may include a plurality of counters including different counting start positions on the transport path T.

In the sort mode, the control section 100 performs sort control for sorting the medium M into the cassette 22 specified based on the information of the medium M detected by the detection section 85. This sort control is performed by the computer 101 executing the program PR. In the sort control, the control section 100 determines the second path 42 according to the information of the detected medium M. The control section 100 guides the medium M so as to be transported along the determined second path 42 by controlling each of the flaps 81 to 83 according to the transport position of the medium M acquired from the count value of the second counter 104.

When the print job PD is received during execution of a sort process of sorting the medium M from the placement tray 21 to the cassette 22, then the control section 100 executes a print process based on the print job PD, giving it priority over the sort process.

Next, the setting data RD will be described with reference to FIG. 5. The setting data RD is, for example, table data indicating a correspondence relationship between the cassette 22 and the type of the medium M. The type of medium M is set for each cassette 22. The type of the medium M in the setting data RD includes at least the size from among the medium type and the size. In the example shown in FIG. 5, the type of medium M includes the medium type and the size. Examples of the medium type include plain paper, paper printed on one side, photographic paper, glossy paper, matte paper, and the like. The size includes, for example, A4 size, B5 size, A3 size, L size, 2L size, post card size, business card size, and the like.

In an example shown in FIG. 5, the first cassette 22A is associated with the plain paper of B5 size. The second cassette 22B is associated with the plain paper of A4 size. The third cassette 22C is associated with the paper printed on one side of A4 size. The fourth cassette 22D is associated with the plain paper of A3 size. The user operates the operation section 16 to set the type of medium M (for example, the medium type and the size) for the cassettes 22. The contents set by the user are stored in the storage section 102 as the setting data RD.

Display Screen

Next, a display screen displayed on the display section 15 of the recording device 11 will be described with reference to FIGS. 7 and 8.

Figure 7:
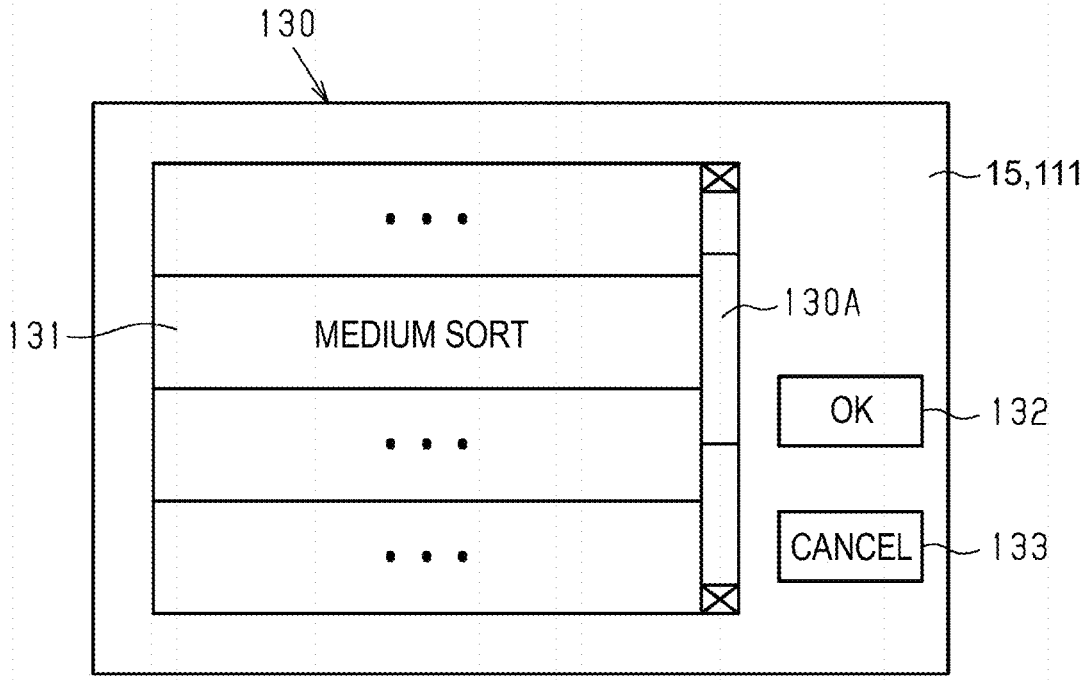
FIG. 7 is a schematic diagram showing a menu screen for selecting a medium sort mode.

FIG. 7 shows a menu screen 130 displayed on the display section 15. The menu screen 130 is configured so that one of a plurality of selection items can be selected. As one of the selection items, a selection item 131 of "medium sort" is prepared. The user operates the operation section 130A on the menu screen 130 as necessary to scroll a menu, thereby displaying a desired selection item on the screen. The user selects the selection item 131 of "medium sort" and then operates an OK button 132 to instruct the recording device 11 to perform a medium sort process. A cancel button 133 is operated to cancel input information.

Figure 8:
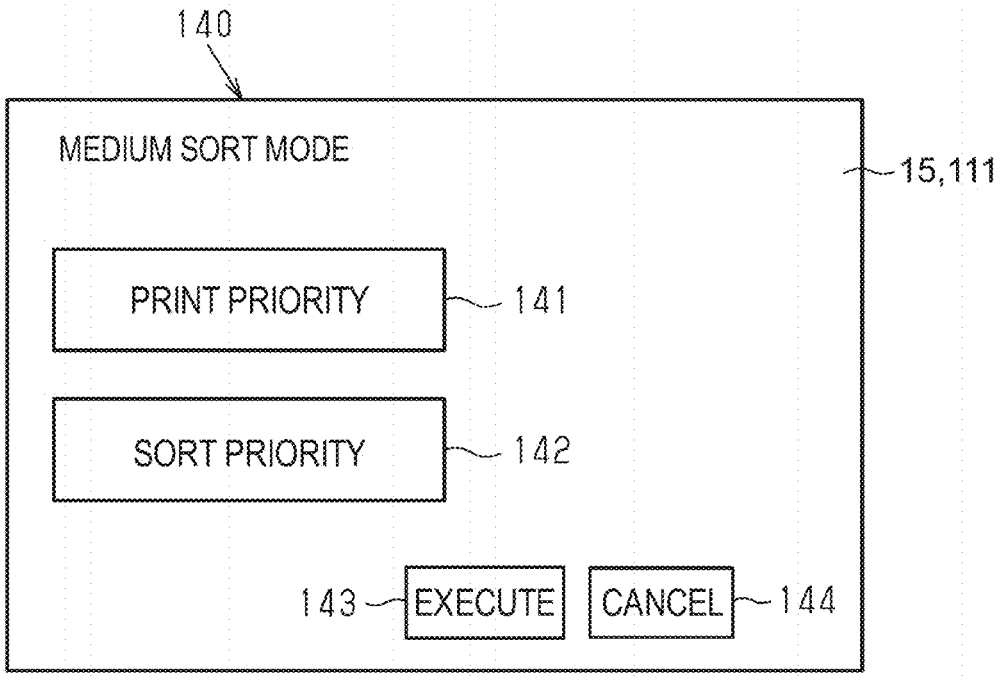
FIG. 8 is a schematic diagram showing a selection screen for selecting print priority and sort priority.

When the control section 100 receives an operation signal of the OK button 132, it displays a selection screen 140 for the medium sort process shown in FIG. 8 on the display section 15. The selection screen 140 is provided with a first selection button 141 for selecting an item "print priority" and a second selection button 142 for selecting an item "sort priority". An execution button 143 is an operation button for instructing execution of process in a selected priority mode. A cancel button 144 is operated to cancel input information on the selection screen 140.

The recording device 11 includes display sections 15, 111 that display the selection screen 140 capable of selecting one of the sort process and the print process to be prioritized, and operation sections 16, 112 that are operated when the one to be prioritized is selected on the selection screen 140. The first selection button 141 and the second selection button 142 are configured so as to be operable via the operation sections 16, 112.

In a state where the one to be prioritized of the selection buttons 141, 142 is selected on the selection screen 140, the user operates the execution button 143 to instruct the recording device 11 to set the priority mode. Here, the "print priority" mode is a mode in which when the print job PD is received during a sort operation, the print process is preferentially executed by interrupt. When a sort job is received during the print process, the print process is continued, and when the print process is finished, the sort process is started. The "sort priority" mode is a mode in which the sort operation is continued even when the print job PD is received during the sort operation, and the print process is executed after the sort operation is completed. In a case where the sort job is received during the print process, the printing may be interrupted at a timing of a division between pages, and the sort process may be preferentially executed by interrupt. The control section 100 gives priority to the one process that was selected by operating the operation section 16, 112 on the selection screen 140. An interrupt print control when the print job PD is received during the sort operation in the print priority mode is performed by the control section 100 executing program shown in a flowchart in FIG. 9.

Operations of Embodiment

Next, operations of the recording device 11 will be described.

The user instructs the print job PD to the recording device 11 by operating the operation section 112 of the host device 110 or the operation section 16 of the recording device 11. The print job PD includes a print command, print condition information, print image data, and the like. The control section 100 specifies the cassette 22 of the feed source by referring to the setting data RD based on the information of the size and the medium type included in the print condition information. When the placement tray 21 is specified as the feed source in the print condition information, the placement tray 21 is set as the feed source. The control section 100 controls the transport unit 40 in accordance with the print command included in the print job PD and controls the recording section 25 based on the print image data. The transport unit 40 feeds the medium M from the cassette 22 or the placement tray 21 as the feed source. The transported medium M is transported along the first path 41. For example, the recording section 25 performs recording on the medium M that is transported from the placement tray 21 along the first feed path 43 and the transport path 45. The recording section 25 performs recording on the medium M that is transported from the cassette 22 along the second feed path 44 and the transport path 45. The recording section 25 records characters or images based on print image data on the medium M. The medium M after recording is discharged to the stacker section 24 by being transported along the first discharge path 46. In the case of double-sided recording, the medium M on which recording on a first side has been completed is inverted by passing through the switchback path 47 and the inversion path 48. The recording section 25 performs recording on a second side of the medium M that is transported on the transport path 45 again after inversion. The medium M after double-sided recording is discharged to the stacker section 24 by being transported along the first discharge path 46.

On the other hand, when the recording device 11 is caused to perform medium sort, the user selects the item of "medium sort" on the menu screen 130 displayed on the display section 15 and then operates the OK button 132. Then, the selection screen 140 shown in FIG. 8 is displayed. Next, on the selection screen 140, whichever of the print process and the sort process to be prioritized is selected. That is, the user operates the first selection button 141 to prioritize the print process, and operates the second selection button 142 to prioritize the sort process. Then, the bundle of the medium M to be sorted is placed on the placement tray 21. In a case where the bundle of the medium M is paper printed on one side or paper that is mixed with paper printed on one side, the medium M is placed on the placement surface 21A with an unrecorded blank surface facing downward. Then, the user operates the execution button 143. When the sort job is received, the control section 100 executes the medium sort process shown in the flowchart of FIG. 9. Hereinafter, with reference to FIG. 9, the medium sort process executed by the computer 101 of the control section 100 will be described. Note that each of the first flap 81 to the third flap 83 is in the first position.

First, in step S11, the control section 100 feeds the medium M. That is, the control section 100 drives the first feed motor 121 to feed one sheet among the medium M on the placement tray 21.

In step S12, the control section 100 detects information on the medium M. Specifically, the detection section 85 detects both front and back sides of the medium M. For example, a downward side of the medium M is referred to as a "front side" and an upward surface is referred to as a "back side". In a case where the detection section 85 is, for example, an image sensor, the control section 100 acquires information relating to a size, information relating to blank paper (neither surface recorded), information relating to a printed surface (recorded surface), information relating to a medium type (material), information relating to a defect such as a tear, and the like as information of the medium M based on images of both front and back sides read by the detection section 85. For example, when the medium Mis paper, the medium type is specified by a texture such as a surface form of paper fibers in an image. In a case where the detection section 85 is an optical sensor, information on the medium M is acquired on a basis of a detection signal thereof. Information such as size, medium type, blank paper (no recorded surfaces), and printed surface (recorded surface) is specified from differences in an amount of light received when the optical sensor receives the light reflected on a surface of the medium M. As the size information, for example, information such as A4 size, B5 size, and A3 size is acquired. As the information on the medium type, for example, information on plain paper, paper printed on one side, photographic paper, glossy paper, matte paper, or the like is acquired. The information on the type of the medium M may be information on only the size from among the size and the medium type. In this case, the detection section 85 may be a sensor capable of detecting the size. Since information on blank paper and information on the printed surface are information for evaluating presence or absence of recording and presence or absence of contamination, only one set of information may be acquired based on the same detection information. The front side of the medium M is a side that, after the medium M has been introduced into the cassette 22, will face the recording section 25 when fed toward the recording section 25.

In step S13, the control section 100 determines whether or not the front and back sides are blank and also have no defects. When the front and back sides are blank and also have no defects, the process proceeds to step S14. On the other hand, when at least one of the front and back sides (one side) has been recorded, or when there are defects such as tears, the process proceeds to step S18.

In step S14, the control section 100 determines whether or not there is a cassette corresponding to the type of medium M. Here, the type of the medium M includes both the size and the medium type set in the setting data RD. The control section 100 specifies the cassette 22 corresponding to the type of the medium M by referring to the setting data RD based on the information of the type (the size and the medium type) of the medium M. When there is a cassette 22 corresponding to the type of the medium M, the process proceeds to step S15. On the other hand, when there is no cassette 22 corresponding to the type of the medium M, the process proceeds to step S24. The type of the medium M may be at least the size among the size and the medium type. For example, it may be determined whether or not there is a cassette 22 corresponding to the size by referring to the setting data RD based on the information of the size.

In step S15, the control section 100 determines whether or not the remaining amount of the cassette 22 is equal to or greater than a threshold. The control section 100 uses the remaining amount detection section 62 to detect the remaining amount of the cassette 22 that was specified as the transport destination, and determines whether or not the detected remaining amount is equal to or greater than the threshold. When the remaining amount of the cassette 22 is not equal to or greater than the threshold (that is, when it is less than the threshold), the process proceeds to step S16. On the other hand, if the remaining amount of the cassette 22 is equal to or greater than the threshold, the process proceeds to step S24.

In step S16, the control section 100 guides the medium M to the bypass path 50 using the first flap 81. The control section 100 drives the actuator to rotate the first flap 81 from the first position to the second position. As a result, the medium M is guided to the bypass path 50 using the first flap 81 and is transported to the second feed path 44.

In step S17, the control section 100 places the medium M into the corresponding cassette 22 using the second flap 82. Specifically, before the transport position of the medium M, which is based on the count value of the second counter 104, reaches the branch position to the transport destination cassette 22, the control section 100 causes the second flap 82 that corresponds to the transport destination cassette 22 to pivot from the first position to the second position. As a result, the medium M that is transported backwards along the second feed path 44 in the reverse transport direction-TD is guided by the second flap 82 located at the second position, and is placed in the transport destination cassette 22. In other words, the medium M is deposited in the transport destination cassette 22.

Figure 11:
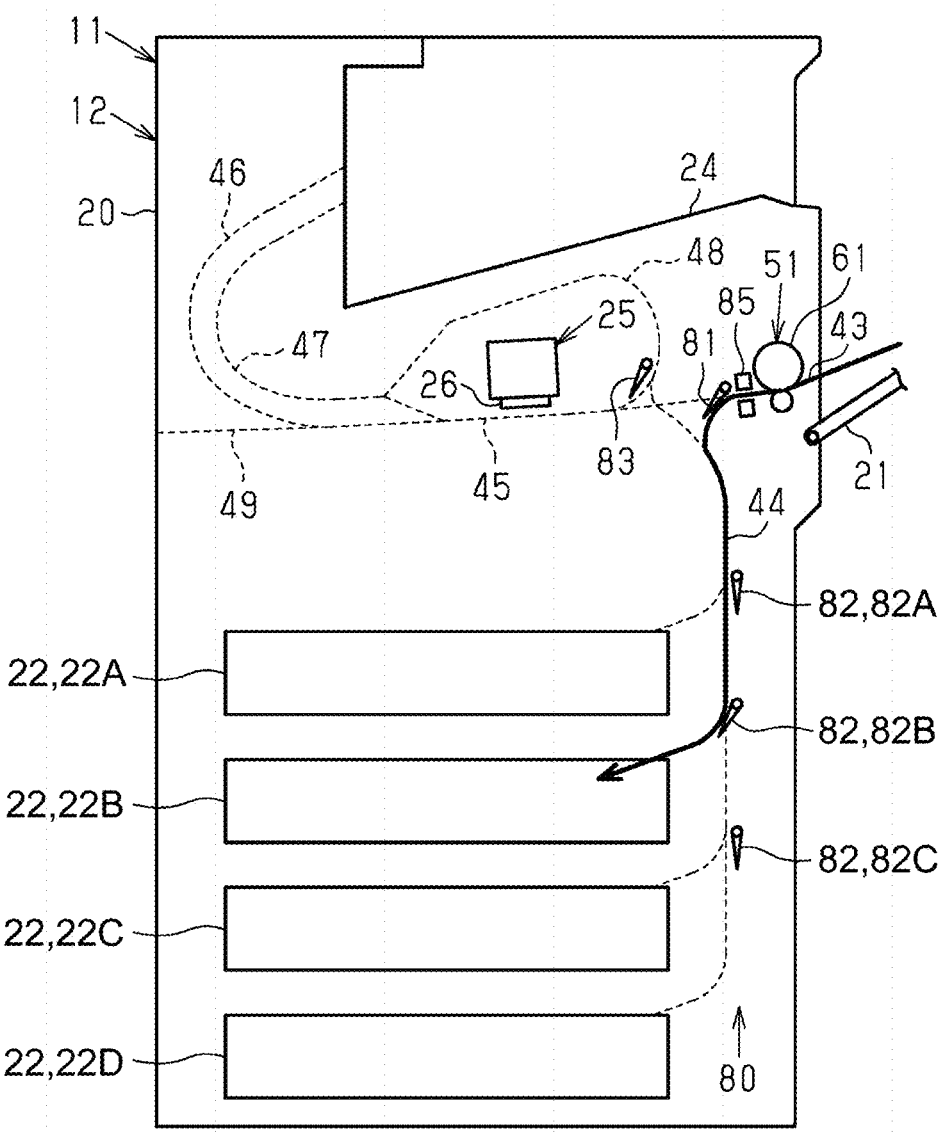
FIG. 11 is a schematic cross-sectional view showing a sorting path when the medium is a blank paper.

In this manner, the type of medium M, the fact that the front and back sides are blank, and the fact that there is no defect are detected as information on the medium M by the detection section 85. The second cassette 22B is specified referring to the setting data RD based on the type of medium M (for example, A4 size plain paper). When the medium Mis blank on the front and back sides and also it has no defects, the medium M is transported in the reverse direction along the bypass path 50 and the second feed path 44 along the path indicated by the thick line in FIG. 11. Then, the medium M is guided using the second flap 82 (second sorting flap 82B) at the second position, and is placed in the second cassette 22B in the second stage. The second cassette 22B is a cassette in which A4 size plain paper is set as shown in the setting data RD in FIG. 5. In the present embodiment, the control section 100 periodically drives the guide motor 90 in forward and reverse directions to reciprocate the pair of edge guides 34, 35 a plurality of times in small increments. The side ends on both sides in the width direction X of the bundle of the medium M are hit by the pair of edge guides 34, 35 to align the bundle of the medium M so as to be aligned in the width direction X.

Note that the edge guides 34, 35 may stand by in a state in which the pair of edge guides 34, 35 are spaced apart from each other by an interval slightly longer than a width dimension of the medium M so that the medium M is reliably placed between the pair of edge guides 34, 35 when the medium M is transported into the cassette 22. At the time of the sort process, the medium M may be drawn into the cassette 22 by rotating the feeding roller 63 in a direction opposite to that of feeding out the medium M in a state in which the hopper 37 is raised. Further, in a state where the hopper 37 is lowered, the medium M may be caused to flow into the cassette 22 by using a transporting force and its own weight. Then, the aligning operation of hitting both side edges of the bundle of the medium M by the pair of edge guides 34, 35 may be performed each time one or a plurality of sheets of medium M are carried in, so that the bundle of the medium M is in an aligned state when used to refill the cassette 22.

On the other hand, when it is determined in step S13 that the front and back sides are not blank and are not without defects (that is, there are defects), the process proceeds to step S18 and the next process is performed.

In step S18, the control section 100 determines whether or not one side is a printed surface and also without defects. Here, a surface which has been recorded on is referred to as a printed surface. A surface that has not been recorded on is a blank surface. Therefore, the process of step S18 can be said to be a process of determining whether or not only one side is blank and is also without defects. When one side is a printed surface and is also without defects, the process proceeds to step S19. On the other hand, if one side is not a printed surface and also not without defects, the process proceeds to step S23. That is, when there are defects, then the process proceeds to step S23, and when both sides are printed surfaces, then the process proceeds to step S23 even if there are no defects.

In step S19, the control section 100 determines whether or not there is a cassette corresponding to the type of medium M. This determination process is the same as step S14. When there is a cassette 22 corresponding to the type of medium M, the process proceeds to step S20. On the other hand, when there is no cassette 22 corresponding to the type of the medium M, the process proceeds to step S24.

In step S20, the control section 100 determines whether or not the printed surface is the front side. In a case where the printed surface is the front side, when the cassette 22 is filled with the medium M via the bypass path 50 and then afterward the medium Mis fed from the cassette 22, then the printed surface of the medium M will be the surface on the side facing the recording head 26. In other words, the image will be printed on the printed surface. For this reason, the control section 100 transports medium M whose printed surface is the front side to the corresponding cassette 22 after inverting the front and back sides. In this determination process, when the printed surface is the front side, the process proceeds to step S21. On the other hand, when the printed surface is not the front side (that is, when the printed surface is the back side), the process proceeds to step S15.

In step S21, the control section 100 inverts the front and back sides of the medium M. Specifically, after the medium M is transported along the first feed path 43 and the transport path 45, the medium M is switched back and transported in the switchback path 47, and thus the medium M is inverted by being transported along the inversion path 48 from the rear end side.

In step S22, the control section 100 guides the medium M to the second feed path 44 using the third flap 83. Specifically, the control section 100 causes the third flap 83 to pivot from the first position to the second position before the inversion of the medium M ends. The inverted medium M is transported to the second feed path 44 via the auxiliary path 58 using the third flap 83.

In step S17, the control section 100 places the medium M into the corresponding cassette 22 using the second flap 82. Specifically, the control section 100 pivots the second flap 82 corresponding to the cassette 22 of the transport destination specified from the type of the medium M from the first position to the second position. As a result, the medium M reversely transported along the second feed path 44 is guided by the second flap 82 at the second position, and is placed in the cassette 22 at the destination. In other words, the medium M is deposited in the transport destination cassette 22.

In this way, in a case where the medium M is paper printed on one side that needs to be inverted, the detection section 85 detects, as the information of the medium M, the type of the medium M, the fact that the front side (one side) is a printed surface and the back side (the other side) is a blank surface, and the fact that there are no defects. The third cassette 22C is specified by referring to the setting data RD based on the type of the medium M (for example, A4 size paper printed on one side).

Figure 12:
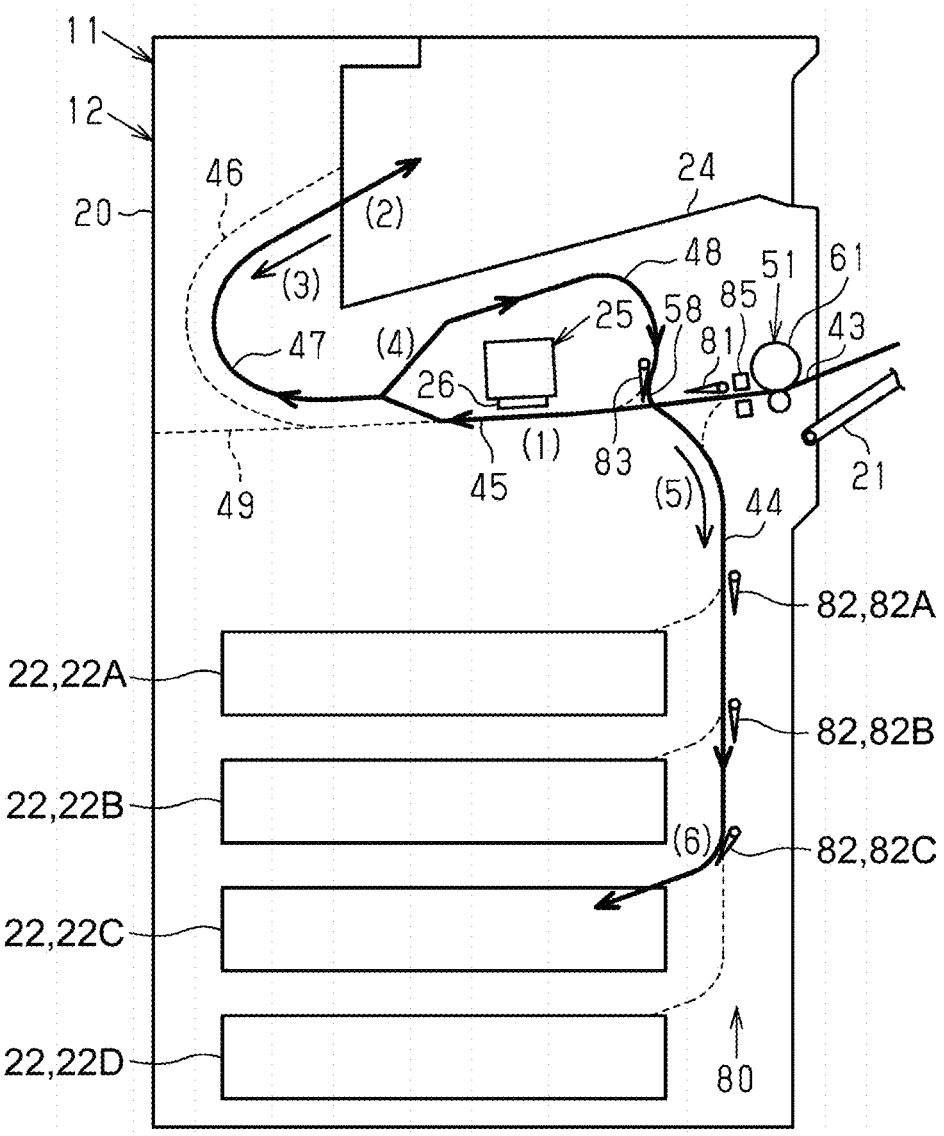
FIG. 12 is a schematic cross-sectional view showing the sorting path when the medium is paper printed on one side.

According to the information of the medium M, when the medium M is paper printed on one side and inversion is necessary for refilling the cassette 22, the medium M is transported along a path in the order of (1), (2), (3), (4), (5), and (6) shown by thick line in FIG. 12. After inversion, the medium M is reversely transported through the second feed path 44, and is guided by the second flap 82 (third sorting flap 82C), which is located at the second position along the path, whereupon it is placed into the third cassette 22C at the third stage. As shown in the setting data RD shown in FIG. 5, the third cassette 22C is a cassette in which A4 size paper that was printed on one side is set. By being inverted, the medium M is placed in the cassette 22 in such a manner that the printed surface faces upward and the blank surface faces downward. Therefore, after that, recording is performed on the blank surface of paper printed on one side fed from the cassette 22.

On the other hand, in step S18, when the control section 100 determines that one side is a printed surface and also has defects, the process proceeds to step S23.

In step S23, the control section 100 determines whether or not there are defects. When there is no defect, the process proceeds to step S24. On the other hand, when there are defects, the process proceeds to step S25.

Figure 13:
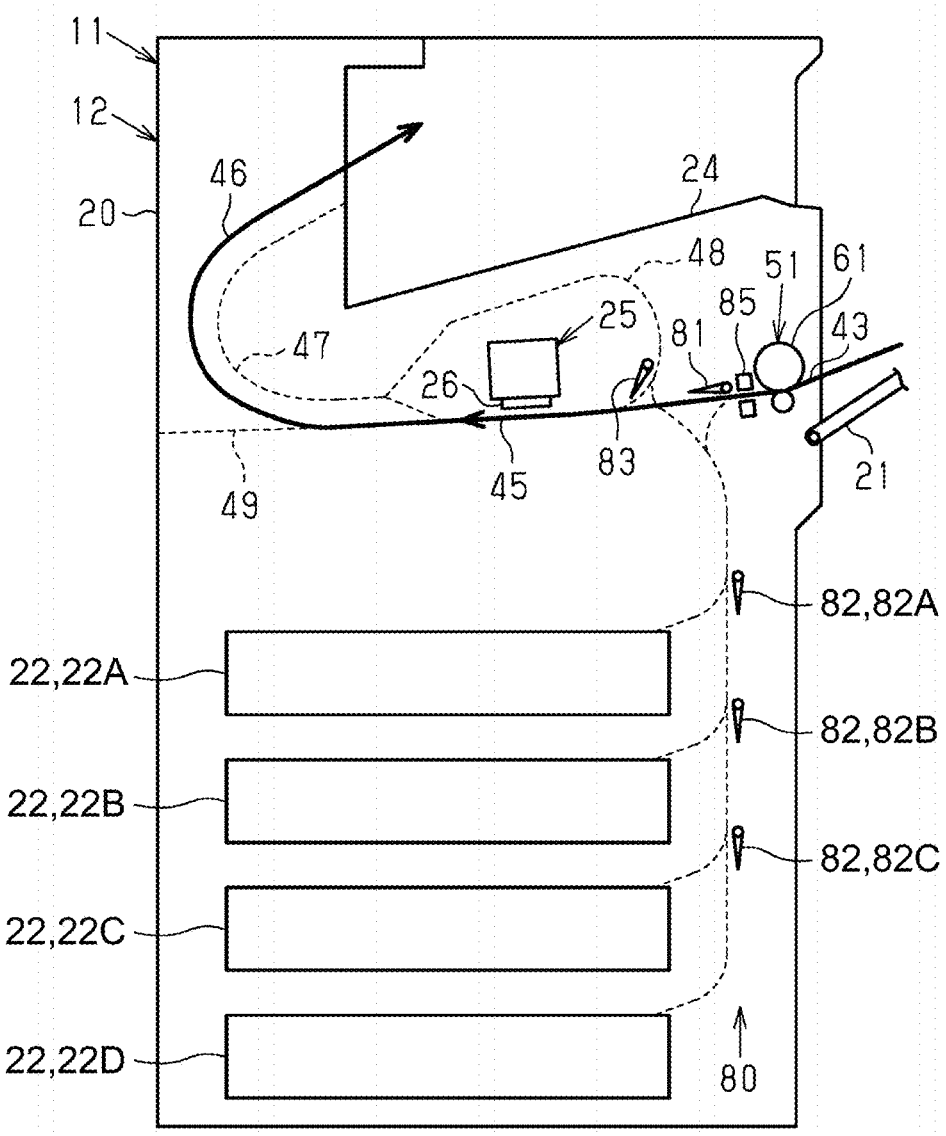
FIG. 13 is a schematic cross-sectional view showing the sorting path when the medium does not correspond to a determination condition.

In step S24, the control section 100 discharges the medium M from the first discharge port 28 to the stacker section 24. Mainly in a following three cases, the medium M is discharged to the stacker section 24. Specifically, in a case where there is no cassette 22 corresponding to the type of the medium M (negative determination in steps S14 and S19), the medium M is discharged to the stacker section 24. In a case where the remaining amount of the cassette 22 is equal to or greater than the threshold (affirmative determination in step S15), the medium M is discharged to the stacker section 24. In a case where the medium M is without defects but has no blank surface (negative determination in Step S23), the medium M is discharged to the stacker section 24. The medium M is discharged from the first discharge port 28 after being transported along the first feed path 43, the transport path 45, and the first discharge path 46. The medium M discharged from the first discharge port 28 is stacked on the stacker section 24. In this way, medium M with defects, medium M when the remaining amount of the transport destination cassette 22 is equal to or greater than the threshold, and medium M without a blank surface are transported along the path indicated by thick line in FIG. 13 and then discharged onto the stacker section 24.

Figure 14:
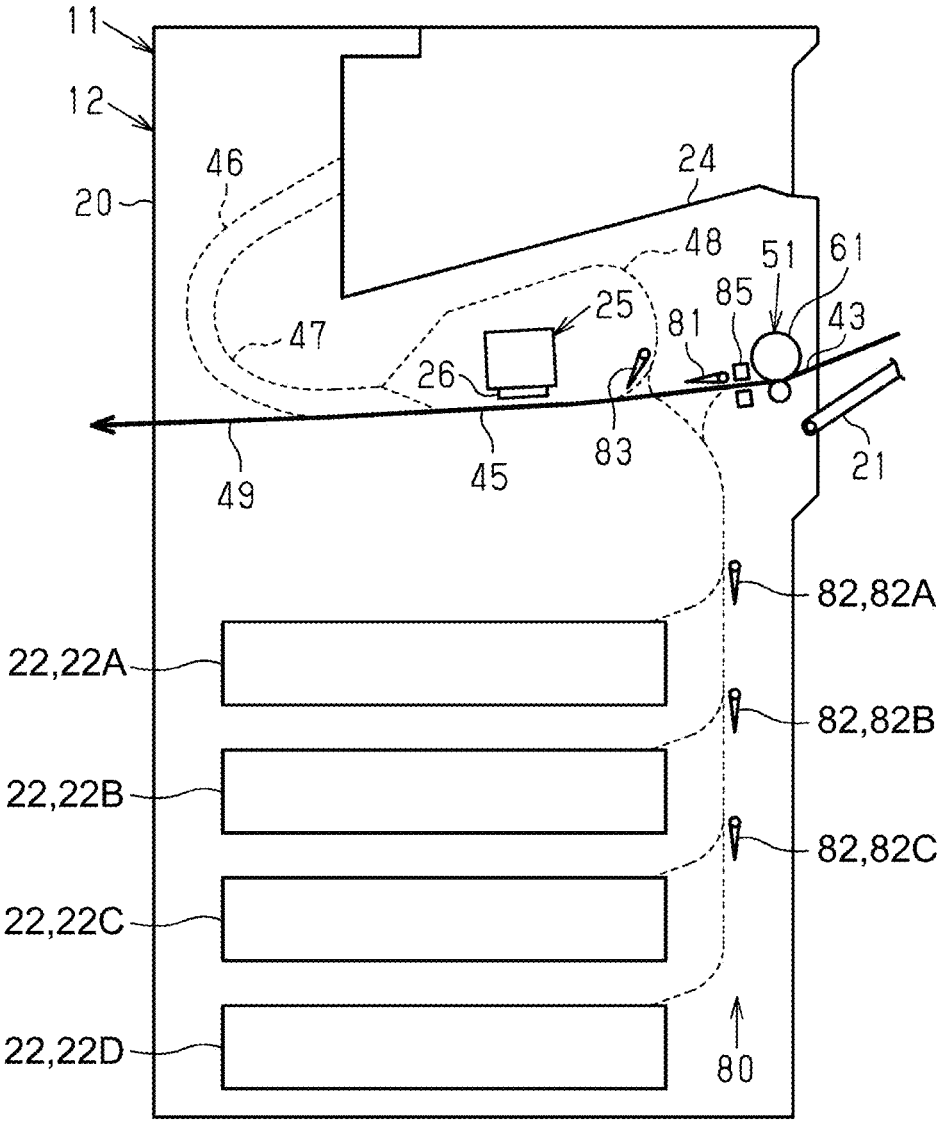
FIG. 14 is a schematic cross-sectional view showing the sorting path when there is a defect in the medium.

In step S25, the control section 100 discards the medium M from the second discharge port 29. For example, the second discharge port 29 of the recording device 11 is connected to a shredder (not shown), and the discharged medium M with defects is shredded by the shredder. Alternatively, a discarding box (not shown) is arranged below the discharge side of the second discharge port 29, and the discharged medium M with defects is discarded in the discarding box. In this way, medium M without a cassette 22 with its specified size or medium M with defects is transported along a path indicated by the thick line in FIG. 14 and discarded to the outside of the device main body 20.

Next, a process performed when print priority is selected on the selection screen 140 shown in FIG. 8 will be described. When a print job PD is received during execution of the medium sort process in the print priority mode, the control section 100 executes the interrupt print control routine shown in FIG. 10. Hereinafter, the interrupt print control when the control section 100 receives the print job PD during a medium sort process will be described.

In step S31, the control section 100 determines whether or not a print job PD has been received. When no print job PD has been received, the routine ends. On the other hand, when a print job PD is received, the process proceeds to step S32.

In step S32, the control section 100 interrupts sorting.

In step S33, the control section 100 continues the sort operation until the medium M being sorted is sorted.

In step S34, the control section 100 determines whether or not the sorting being performed has been completed. When the sorting is completed, the process proceeds to step S35. On the other hand, when the sorting is not completed, the process returns to step S33 and the sorting operation is continued until sorting is completed.

In step S35, the control section 100 executes the print job PD. In other words, even when a print job PD is received, the medium M waits without executing the print job PD while the medium M being sorted is on the transport path T.

In step S36, the control section 100 feeds the medium M from the specified cassette 22. A medium M is fed from the designated cassette 22 specified by referring to the setting data RD based on the information of the size and the medium type included in the print condition information.

In step S37, the control section 100 executes printing. The control section 100 controls the recording section 25 based on the print image data to cause the recording section 25 to record a character or an image based on the print image data.

In step S38, the control section 100 performs shift discharge. During sorting, there is a possibility that sorted medium M exists on the stacker section 24. In this case, when recorded medium M is stacked at the same position on the stacker section 24, there is a possibility that the sorted medium M and the recorded medium M printed by interrupt will coexist. Therefore, the first discharging section 54 performs a shift process in which the sorted medium M and the recorded medium M on which printing has been performed by interrupt are discharged with their positions shifted in the width direction X. As a result of this shift process, the sorted medium M and the recorded medium M printed by interrupt are stacked on the stacker section 24 at different positions in the width direction X so that they can be distinguished from each other.

In step S39, the control section 100 determines whether or not the print job PD has been completed. When the print job PD is, for example, a continuous print process for a plurality of sheets, there are still remaining prints after one sheet has been printed. When there is remaining print and the print job PD is not completed, the process returns to step S36, and the remaining print is executed. That is, feeding, printing, and shift discharge are performed for each of the remaining sheets to be printed.

In step S40, the control section 100 determines whether or not there is a subsequent print job PD. When there is a subsequent print job PD, the process returns to step S35 and the subsequent print job PD is executed. On the other hand, when there is no next print job PD, the process proceeds to step S41.

In step S41, the control section 100 resumes the sort operation.

As described above, in the print priority mode, when a print job PD is received during a sort operation, the print process is prioritized over the sort process by executing printing by interrupt.

On the other hand, in the sort priority mode, the control section 100 continues the sort operation even when a print job PD is received. When all sort operations are completed, the print job PD is executed. In this case, once the sort process is started, printing is not performed until the sort process is completed.

For example, the sort priority mode is selected during a time period in which the printing is not performed after the end of working hours. In this case, since frequency of receiving a print job PD is low, by giving priority to the sort process over the print process, a delay in the sort process due to interruption of another process or the like is suppressed.

Effects of Embodiment

According to the embodiment, the following effects can be obtained.

(1) A recording device 11 includes a device main body 20 including a recording section 25; a placement tray 21 configured to support a medium M; and a cassette 22 provided below the recording section 25 and the placement tray 21 and configured to accommodate a medium M.

The device main body 20 includes a first path 41 configured to transport the medium M placed on the placement tray 21 to the recording section 25 and further to transport the recorded medium and a second path 42 configured to transport medium placed on the placement tray 21 to the cassette 22.

According to this configuration, recording is performed on the medium M by the recording section 25 by transporting the medium M placed on the placement tray 21 along the first path 41. When a medium bundle is placed on the placement tray 21, the medium M is transported from the placement tray 21 to the cassette 22 along the second path 42. Therefore, even when a user does not directly accommodate (set) a medium bundle in the cassette 22, the medium M can be used to refill the cassette 22 by placing the medium bundle on the placement tray 21. In a large-sized recording device 11 such as an office printer, the cassette 22 is arranged at a height lower than a waist of the user. Therefore, it is necessary for the user to perform a refill operation or an exchange operation for the cassette 22, which is performed by holding a relatively heavy bundle of medium M, in a bent posture. As a result, the refill operation and the exchange operation of the medium M become a heavy workload for the user. On the other hand, according to the recording device 11 of the present embodiment, when the bundle of medium M is placed on the placement tray 21 at a higher position than the cassette 22, the recording device 11 automatically refills the cassette 22 with the medium M on the placement tray 21. Therefore, the workload of the user can be reduced.

(2) The second path 42 is partially common with the first path 41.

According to this configuration, it is possible to transport the medium M from the placement tray 21 to the cassette 22 using a part of the first path 41 that transports the medium M from the placement tray 21 to the recording section 25 as the second path 42. Therefore, the size of the newly added second paths 42 can be reduced. For example, an increase in a size of the recording device 11 can be suppressed.

(3) The recording device 11 includes a first feed path 43 configured to feed the medium M from the placement tray 21 toward the recording section 25; a second feed path 44 configured to feed the medium M from the cassette 22 toward the recording section 25; and a bypass path 50.

The bypass path 50 branches off from an intermediate position of the first feed path 43 and is connected to the second feed path 44.

The recording device 11 includes a first flap 81 configured to guide the medium M from the first feed path 43 to the bypass path 50.

According to this configuration, it is possible to transport the medium M from the placement tray 21 to the cassette 22 through the bypass path 50 that connects the first feed path 43 and the second feed path 44. The length of the transport path from the placement tray 21 to the cassette 22 can be shortened compared to the configuration in which the medium M is transported to the cassette 22 via a merging position of the first feed path 43 and the second feed path 44.

(4) The recording device 11 includes a detection section 85 that detects information on the medium M at a position at an intermediate position of the second path 42.

The recording device 11 sorts the medium M placed on the placement tray 21 based on the information.

According to this configuration, the medium M placed on the placement tray 21 can be sorted based on the information detected at the intermediate position of the second path 42. Here, a sorting includes a sorting between a plurality of cassettes 22 and a sorting between a cassettes 22 and other than a cassette 22. For example, the cassettes 22 may be sorted according to a size as an example of the information. Further, as an example of the information, the cassette 22 and other than the cassette 22 may be sorted according to whether or not the size is set, whether or not there are defects, or the like. The information is not limited to size, and may be any information as long as the information can be used for sorting, such as a medium type, applicable/non-applicable, and presence or absence of defects. Furthermore, since the recording device 11 refills the cassette 22 with the medium M of a type as set, it is possible to reduce frequency of occurrence of a refill error, an exchange error, or the like in which a type and combination of the cassette 22 and the medium M are different from a setting, compared to a case in which the user directly refills or exchanges the medium M in the cassette 22.

(5) The detection section 85 determines the size of the medium M.

According to this configuration, the medium M transported from the placement tray 21 to the cassette 22 can be sorted according to their sizes.

(6) The recording device 11 includes a storage section 102 configured to store setting data RD associating the cassette 22 with the size of the medium M to be accommodated in the cassette 22.

The recording device 11 transports the medium M to the cassette 22 specified by referring to the setting data RD based on the information of the size detected by the detection section 85.

According to this configuration, the medium M can be transported to the cassette 22 specified based on the information of the size detected by the detection section 85.

(7) The recording device 11 includes discharging sections 54, 57 to which the recorded medium M recorded by the recording section 25 at an intermediate position of the first path 41 is discharged.

When there is no cassette 22 specified from the size detected by the detection section 85, the recording device 11 discharges the medium M of the size to the discharging sections 54, 57.

According to this configuration, when there is no cassette 22 specified by the size detected by the detection section 85, the medium M can be discharged to the discharging sections 54, 57. For example, when there is no cassette 22 specified by the size detected by the detection section 85, it is possible to avoid an inappropriate process in which an operation of refilling the cassette 22 with the medium M is interrupted or a medium M of an inappropriate size is used to refill the cassette 22.

(8) The recording device 11 includes a plurality of cassettes 22.

The recording device 11 includes a sorting mechanism 80 that sorts the medium M into the cassette 22 according to the information of the medium M detected by the detection section 85.

According to this configuration, the sorting mechanism 80 can sort the medium M into the cassette 22 according to the information of the medium M detected by the detection section 85.

(9) The second feed path 44 includes a common path 44A through which the medium M fed from the plurality of cassettes 22 commonly pass, and an individual path 44B from the plurality of cassettes 22 to the common path 44A.

The sorting mechanism 80 includes second flaps 82 that guide the medium M from the common path 44A to the individual paths 44B.

According to this configuration, the sorting mechanism 80 can sort the medium M to the corresponding cassette 22 by guiding the medium M from the common path 44A to the individual path 44B by the second flap 82.

(10) The recording device 11 includes a heat roller 67 configured to heat the medium M at a position at an intermediate position of the second path 42.

The recording device 11 transports the medium M heated by the heat roller 67 to the cassette 22.

According to this configuration, it is possible to refill the cassette 22 with the medium M, which heated by the heat roller 67 to eliminate or reduce wrinkles.

(11) The recording device 11 includes a detection section 85 that detects information on the medium M at a position at an intermediate position of the second path 42.

The detection section 85 detects both front and back sides of the medium M to determine whether or not the medium M is a first medium in which both sides are unrecorded as the information.

The recording device 11 transports the medium M determined as the first medium by the detection section 85 to the cassette 22 via the bypass path 50.

According to this configuration, it is possible to transport the medium M of which both sides are unrecorded to the cassette 22 through a path having a short path length via the bypass path 50. Normally, the medium M accommodated in the cassette 22 is the first medium of which both sides are unrecorded (for example, both surfaces are blank surfaces) in many cases. Such a first medium M can be quickly used to refill from the placement tray 21 to the cassette 22 through a short path.

(12) The first path 41 includes an inversion path for inverting the medium M in which recording on a first side is completed in an orientation in which a second side, which is a side on an opposite side to the first side, faces the recording section 25 during double-sided recording for recording on both sides of the medium M.

The detection section 85 determines a second medium in which only one side has been recorded as the information for detecting both front and back sides of the medium M and which needs to be inverted the front and back sides before being transported to the cassette 22. The recording device 11 transports the medium M determined as the second medium by the detection section 85 to the cassette 22 after inverting the medium in the inversion path.

According to this configuration, by inverting the second medium M which has been recorded on only one side and needs to be inverted in the inversion path, the second medium M can be used to refill the cassette 22 with the correct front and back orientation.

(13) The detection section 85 detects a defect in the medium M as the information.

The recording device 11 discharges the medium M in which the defect is detected to the discharging sections 54, 57.

According to this configuration, the medium M with the defect can be discharged without being used to refill the cassette 22.

(14) The discharging sections 54, 57 include a first discharging section 54 and a second discharging section 57 different from the first discharging section 54.

The recording device 11 separately discharges the medium M with the defect and the non-corresponding medium without the cassette 22 specified from the detected information (for example, size) to the first discharging section 54 and the second discharging section 57.

According to this configuration, the medium M with the defect and the non-corresponding medium without the cassette 22 to be a transfer destination are discharged to separate discharging sections 54,57 while avoiding refill of the cassette 22. Therefore, it is possible to prevent a plurality of different types of medium M from being mixed at a discharge destination.

(15) The first discharging section 54 includes a stacker section 24 provided in the device main body 20.

The second discharging section 57 includes a second discharge port 29 which is an example of a discharge port through which the medium M is configured to be discharged to outside of the device main body 20.

The recording device 11 discharges the non-corresponding medium M to the stacker section 24 and discards the medium M with the defect from the second discharge port 29 to the outside of the device main body 20.

According to this configuration, the non-corresponding medium M without a cassette 22 to be refilled and the medium M with the defect can be discharged separately.

(16) The recording device 11 includes a remaining amount detection section 62 configured to detect a remaining amount of the medium M accommodated in the cassette 22.

The recording device 11 does not transport the medium M from the placement tray 21 to the cassette 22 when the remaining amount in the cassette 22 of the transport destination is equal to or greater than a threshold.

According to this configuration, it is possible to avoid that the medium M is used to refill the cassette 22 in which the remaining amount is equal to or greater than the threshold. For example, it is possible to prevent the cassette 22 from being refilled with an excessive amount of sheets of medium M, such as exceeding the maximum number of medium M accommodated in the cassette 22 or a specified number of medium M.

(17) The cassette 22 includes a positioning mechanism 33 including a pair of edge guides 34, 35 configured to position the medium M at least in a width direction.

The positioning mechanism 33 includes a guide motor 90 as an example of a power source that moves the pair of edge guides 34, 35 in a positioning direction (width direction X).

The recording device 11 causes the pair of edge guides 34, 35 to hit side ends on both sides of a bundle of the medium M transported to a cassette 22.

According to this configuration, it is possible to refill using a bundle of medium M that was transported to the cassette 22 in an aligned state with little deviation in the positioning direction.

(18) When the recording device 11 accepts the print job PD during execution of the sort process for sorting the medium M from the placement tray 21 to the cassette 22, the recording device 11 executes print process based on the print job with priority over sort process.

According to this configuration, when the print job PD is received during the sort process, the print process is executed prior to the sort process. Therefore, it is possible to suppress waiting until all of the sort process is completed.

(19) The recording device 11 includes a display section 15 configured to display a selection screen 140 selectable one of the sort process and the print process with one priority and an operation section 16 to be operated when the one priority is selected on the selection screen 140.

The recording device 11 gives priority to one process selected by operating the operation section 16 on the selection screen 140.

According to this configuration, it is possible to select one of the sort process and the print process to be prioritized. Since one to be prioritized can be selected according to a time zone or the like, usability for the user is improved.

Modifications

The present embodiment can be modified as follows. The present embodiment and the following modifications can be implemented in combination with each other within a range that is not technically contradictory.

The detection section 85 may not be provided. For example, the user may specify the type of the medium M and the cassette 22 as a sorting destination by operating the operation section 16. The control section 100 recognizes that the medium M on the placement tray 21 is a specified type, and transports the medium M to a specified cassette 22. The control section 100 may store setting data RD that associates the specified cassette 22 with the type of the medium M.

At least one of the bypass path 50 and the auxiliary path 58 may not be provided. For example, the medium M may be guided from the rear end to the second feed path 44 by the switchback transport in which the medium M is transported from the placement tray 21 to the transport path 45 and then reversely transported through the transport path 45. A configuration may be adopted in which the medium M inverted via the inversion path 48 is once guided to the transport path 45, and thereafter, the medium M is guided from the rear end to the second feed path 44 by switchback transport in which the medium M is reversely transported on the transport path 45. In a case where the medium M is guided from the rear end to the second feed path 44, the placement direction of the medium M on the placement tray 21 may be the opposite to the front and back orientation of the embodiment. In these cases, all of the second path 42 may have the same configuration as that of the first path 41.

When the user instructs the sort process after changing the setting data RD, in a case where the remaining amount detection section 62 detects that the medium M having a size different from a new setting remains in the cassette 22, the control section 100 may notify the user of the fact using the display sections 15, 111 or a speaker. Further, after the notification, a selection screen may be displayed on the display sections 15, 111 so that the user can select whether or not to perform a process of discharging a remaining medium M from the cassette 22. When the user selects execution of a medium discharge process on the selection screen, the control section 100 may perform the discharge process of discharging the medium M from the cassette 22. In this case, the remaining medium M is discharged from the first discharging section 54 onto the stacker section 24, for example.

Although the medium M is used to refill the cassette 22 in the sort process of the above-described embodiment, the medium M in the cassette 22 may be exchanged. First, the control section 100 discharges the medium M in the cassette 22 to the stacker section 24. When the cassette 22 becomes empty, next, the control section 100 transports the medium M on the placement tray 21 to the cassette 22 by the sort process and refills the cassette 22. At this time, when the size of the medium M is the same before and after the exchange and the medium type is different, an interval between the pair of edge guides 34, 35 and a position of the third edge guide 36 may be left as they are. When the exchange is accompanied by a change in size, the control section 100 may control the guide motor 90 of the drive source to change the interval between the pair of edge guides 34, 35. It is preferable that a drive source (not shown) such as a motor is also provided for the third edge guide 36, and that the position of the third edge guide 36 can be changed by controlling the drive source by the control section 100.

A reservation function may be provided in which the control section 100 automatically starts the sort process when the remaining amount of the cassette 22 becomes less than or equal to a threshold. In the reservation function, the control section 100 starts the sort operation when the remaining amount, which is a result of the detection by the remaining amount detection section 62, becomes less than the threshold. The reservation function may start the sort process at a point in time when a set time elapses from a time of reservation, or may start the sort process at a point in time when a specified time specified by the user is reached. As the set time of the reservation function, the user may select one from a plurality of predetermined set times, or the user may input and specify a desired time as a numerical value within a range of the maximum time.

When the remaining amount of the cassette 22 becomes empty, the cassette 22 may be refilled using the bundle of medium M prepared in advance on the placement tray 21. For example, in a case where the printing is performed on a larger number of sheets than the maximum number of sheets that can be accommodated in the cassette 22, when the cassette 22 becomes empty, the printing is interrupted, and subsequently, using the medium M from the placement tray 21 to refill an empty cassette 22 is automatically performed. For example, the control section 100 may be configured to automatically restart an interrupted printing at a time point when the medium M is refilled to an amount equal to or greater than a threshold. The threshold at this time may be the number of sheets required for remaining printing or the number of sheets obtained by adding a small margin to this number of sheets.

In the embodiment, in a case where the sort process is interrupted because it is determined that the medium M in the cassette 22 is equal to or greater than a threshold (upper limit threshold) from the detection result of the remaining amount detection section 62, the sort process may be started at a time point when the medium M is consumed from the cassette 22 and the remaining amount becomes less than a threshold (refill start threshold).

The recording device 11 may include a sort function of sorting the medium bundles placed on the placement tray 21 for each type and stacking the medium M on the stacker section 24 by shifting a position for each type by a shift function of the first discharging section 54. For example, a medium bundle in which different types of medium M are mixed is placed on the placement tray 21. The recording device 11 transports the medium M to the first discharging section 54 while determining the type of the medium M transported from the placement tray 21 by the detection section 85, and stacks the medium M on the stacker section 24 by shifting a position in the width direction X for each type by the shift function of the first discharging section 54.

The medium M may be used to refill the cassette 22 by transporting the medium M supplied from the large-capacity medium supply device to the recording device 11 via the connection section 23 to the cassette 22.

A configuration may be adopted in which a path through which the medium M is transported from the placement tray 21 to the cassette 22 is a path that passes through the recording position PP, the recording section 25 records a standard design, ruled lines, a standard sentence, or the like on the medium M passing through the recording position PP, and then the medium M after recording is transported to the cassette 22. By performing recording on the medium M in the process of using the medium M from the placement tray 21 to refill the cassette 22 in this manner, the medium M on which recording has been performed may be used to refill the cassette 22 in an orientation in which the record surface thereof is the front side (surface to be recorded).

The present disclosure may be applied to a recording device 11 including only one cassette 22. For example, the present disclosure may be applied to a recording device 11 smaller than an office printer. The recording device 11 does not store the setting data RD. The user inputs information on the size of the medium M to be used to refill the cassette 22 by operating the operation section 16. When the size of the medium M detected by the detection section 85 is the same as the specified size, the control section 100 transports the medium M to the cassette 22, and when the sizes are different, the control section 100 discharges the medium M to the discharging section 54 without transporting the medium M to the cassette 22.

The medium M with defects may be discharged to the stacker section 24. In this case, the medium M with defects and the medium M of the type that is not associated with the cassette 22 may be stacked on the stacker section 24 by shifting positions in the width direction X by the shift function of the first discharging section 54.

The recording device 11 is not limited to a serial printer or a line printer, but may be a page printer. In a case where the recording device 11 is a line printer, the recording section 25 does not include a carriage, and includes a recording head capable of simultaneously printing a range longer than the maximum width of the medium M. The recording head 26 performs printing on the medium M which is transported at a predetermined speed by the transport section 53. In this case, the recording head 26 may be an ejection head (ejection section) that ejects liquid such as ink. The recording section 25 includes a carriage that supports the recording head 26, and the recording head 26 performs recording on the medium M in a process in which the carriage reciprocates in the scanning direction.

The recording device 11 is not limited to an ink jet printer, but may be an electrophotographic printer such as a laser printer. The recording device 11 may be a dot impact type printer or a thermal transfer type printer.

The recording device 11 is not limited to a multifunction device, and may be a printer without the scanner section 13.

Hereinafter, a technical idea derived from the above-described embodiment and the modifications and its effects will be described.

(A) A recording device includes a device main body including a recording section; a placement tray configured to support a medium; and a cassette provided below the recording section and the placement tray and configured to accommodate a medium, wherein the device main body includes a first path configured to transport medium placed on the placement tray to the recording section and further to transport the recorded medium and a second path configured to transport medium placed on the placement tray to the cassette.

According to this configuration, recording is performed on the medium by the recording section by transporting the medium placed on the placement tray along the first path. When a medium bundle is placed on the placement tray, the medium is transported from the placement tray to the cassette along the second path. Therefore, even when a user does not directly place the medium bundle in the cassette, the user can refill the cassette with the medium by placing the medium bundle on the placement tray.

(B) In the above recording device the second path may be partially common to the first path.

According to this configuration, it is possible to transport the medium from the placement tray to the cassette by using a part of the first path that transports the medium from the placement tray to the recording section as the second path. Therefore, a number of newly added second path can be reduced. For example, an increase in a size of the recording device can be suppressed.

(C) The above recording device may include a first feed path configured to feed the medium from the placement tray toward the recording section; a second feed path configured to feed the medium from the cassette toward the recording section; a bypass path branched off from an intermediate portion of the first feed path and connected to the second feed path; and a first flap configured to guide the medium from the first feed path to the bypass path.

According to this configuration, it is possible to transport the medium from the placement tray to the cassette through the bypass path that connects the first feed path and the second feed path. The length of the transport path from the placement tray to the cassette can be shortened compared to the configuration in which the medium is transported to the cassette via a merging position of the first feed path and the second feed path.

(D) The above recording device may include a detection section that detects information of the medium at an intermediate position of the second path, wherein the recording device may sort the medium placed on the placement tray based on the information.

According to this configuration, the medium placed on the placement tray can be sorted based on the information detected at the intermediate position of the second path. Here, sorting is not limited to sorting between a plurality of cassettes, but also includes sorting between a cassette and other than a cassette. For example, sorting may be to cassettes according to size as an example of information, or sorting may be to a cassette and to somewhere besides a cassette according to a set size or a non-set size. The information is not limited to size, and may be any information as long as the information can be used for sorting, such as a medium type, applicable/non-applicable, and presence or absence of defects.

(E) In the above recording device, the detection section may determine a size of the medium.

According to this configuration, it is possible to sort the medium transported from the placement tray to the cassette according to the size.

(F) The above recording device may include a storage section configured to store setting information associating the cassette with the size of the medium to be accommodated in the cassette, wherein the above recording device may transport the medium to the cassette specified by referring to the setting information based on the information of the size detected by the detection section.

According to this configuration, it is possible to transport the medium to the cassette specified based on the information of the size detected by the detection section.

(G) The above recording device may include a discharging section to which is discharged the recorded medium recorded by the recording section at an intermediate position of the first path, wherein when there is no cassette specified from the size detected by the detection section, the above recording device may discharge the medium of the size to the discharging section.

According to this configuration, in a case where there is no cassette specified from the size detected by the detection section, it is possible to discharge the medium to the discharging section. For example, in a case where there is no cassette specified from the size detected by the detection section, it is possible to avoid interruption of an operation of refilling the cassette 22 with the medium M or using a medium of an inappropriate size to refill the cassette.

(H) The above recording device may include a plurality of the cassettes and the above recording device may include a sorting mechanism that sorts the medium into the cassettes according to the information of the medium detected by the detection section.

According to this configuration, it is possible to sort the medium into the cassette according to the information of the medium detected by the detection section by the sorting mechanism.

(I) In the above recording device, the above recording device may include a common path through which the medium fed from the plurality of cassettes toward the recording section commonly passes and individual paths from the plurality of cassettes to the common path and the sorting mechanism may include second flaps that guide the medium from the common path to the individual paths.

According to this configuration, the sorting mechanism can sort the medium into the corresponding cassettes by guiding the medium from the common path to the individual paths by the second flaps.

(J) The above recording device may include a heat roller configured to heat the medium at an intermediate position of the second path, wherein the recording device may transport the medium heated by the heat roller to the cassette.

According to this configuration, it is possible to refill the cassette with the medium, which heated by the heat roller to eliminate or reduce wrinkles.

(K) The above recording device may include a detection section that detects information of the medium at an intermediate position of the second path, wherein the detection section may detect both front and back sides of the medium to determine whether or not the medium is a first medium in which both sides are unrecorded as the information and the recording device may transport the medium determined as the first medium by the detection section to the cassette via the bypass path.

According to this configuration, it is possible to transport the medium of which both sides are unrecorded to the cassette through a path having a short path length via the bypass path.

(L) In the above recording device, the first path may include an inversion path for inverting the medium in which recording on a first side is completed in an orientation in which a second side, which is a side on an opposite side to the first side, faces the recording section during double-sided recording for recording on both sides of the medium, the detection section may determine a second medium in which only one side has been recorded as the information for detecting both front and back sides of the medium and which needs to be inverted front and back sides before being transported to the cassette, and the recording device may transport the medium determined as the second medium by the detection section to the cassette after inverting the medium in the inversion path.

According to this configuration, by inverting the second medium which has been recorded on only one side and needs to be inverted in the inversion path, the second medium can be used to refill the cassette with the correct front and back orientation.

(M) The above recording device may include a discharging section to which the recorded medium recorded by the recording section at an intermediate position of the first path is discharged, wherein the detection section may detect a defect in the medium M as the information and the above recording device may discharge the medium in which the defect is detected to the discharging section.

According to this configuration, the medium with the defect can be discharged without being used to refill the cassette.

(N) In the above recording device, the discharging section may include a first discharging section and a second discharging section different from the first discharging section and the recording device may discharge the medium with the defect and the non-corresponding medium without the cassette specified from the information separately to the first discharging section and the second discharging section.

According to this configuration, medium with a defect and non-corresponding medium without a cassette as a transfer destination are discharged to separate discharging sections, while avoiding that they are used to refill a cassette. Therefore, it is possible to prevent a plurality of different types of medium M from being mixed at a discharge destination.

(O) In the above recording device, the first discharging section may include a stacker section provided in the device main body, the second discharging section may include a discharge port through which the medium is configured to be discharged to outside of the device main body, and the recording device may discharge the non-corresponding medium to the stacker section and discard the medium with the defect from the discharge port to outside of the device main body.

According to this configuration, non-corresponding medium without a cassette to refill and medium with defects can be discharged separately.

(P) The above recording device may include a remaining amount detection section configured to detect a remaining amount of medium accommodated in the cassette, wherein the above recording device may not transport the medium from the placement tray to the cassette when the remaining amount in the transport destination cassette is equal to or greater than a threshold.

According to this configuration, it is possible to prevent the medium from being used to refill the cassette in which the remaining amount is equal to or greater than the threshold. For example, it is possible to prevent the cassette from being refilled with an excessive amount of sheets of medium, such as exceeding the maximum number of medium accommodated in the cassette or a specified number of medium.

(Q) In the above recording device, the cassette may include a positioning mechanism including a pair of edge guides configured to position the medium at least in a width direction and the positioning mechanism may include a power source that moves the pair of edge guides in a positioning direction, and may perform an aligning operation in which the pair of edge guides hits both side edges of a bundle of medium transported to the cassette.

According to this configuration, it is possible to refill using a bundle of medium that was transported to the cassette in an aligned state with little deviation in the positioning direction.

(R) When the recording device accepts the print job during execution of the sort process for sorting the medium from the placement tray to the cassette, the above recording device may execute print process based on the print job with priority over sort process.

According to this configuration, when the print job is received during the sort process, the print process is executed prior to the sort process. Therefore, it is possible to suppress waiting until all of the sort process is completed.

(S) The above recording device may include a display section configured to display a selection screen enabling selection of one of the sort process and the print process to prioritize and an operation section to be operated when the one to prioritize is selected on the selection screen, wherein the above recording device may give priority to one process selected by operating the operation section on the selection screen.

According to this configuration, it is possible to select one of the sort process and the print process to be prioritized. Since one to be prioritized can be selected according to a time zone or the like, usability for the user is improved.

What is claimed is:

1. A recording device comprising:

a device main body including a recording section;

a placement tray configured to support a medium;

a feed roller configured to feed the medium placed on the placement tray;

a cassette provided below the recording section and the placement tray and configured to accommodate the medium;

a detection section that detects information of the medium, the detection section being provided between the feed roller and the recording section; and a discharging section, wherein the recorded medium recorded by the recording section is discharged to the discharging section at an intermediate position of a first path, wherein:

the detection section detects a defect in the medium as the information, the recording device discharges the medium in which the defect is detected to the discharging section, the discharging section includes a first discharging section that includes a stacker section provided in the device main body, the discharging section includes a second discharging section that includes a discharge port configured so that the medium is discharged to outside of the device main body, and the recording device discharges a non-corresponding medium to the stacker section and discards the medium with the defect from the discharge port to the outside of the device main body.

2. The recording device according to claim 1, further comprising:

a first feed path configured to feed the medium from the placement tray to the recording section;

a second feed path configured to feed the medium from the cassette to the recording section;

a bypass path branched off from an intermediate portion of the first feed path and connected to the second feed path; and a first flap configured to guide the medium from the first feed path to the bypass path.

3. The recording device according to claim 1, wherein the detection section determines a size of the medium.

4. The recording device according to claim 3, further comprising:

a storage section configured to store setting information associating the cassette with the size of the medium to be accommodated in the cassette, wherein the recording device transports the medium to the cassette specified by referring to the setting information based on the information of the size detected by the detection section.

5. The recording device according to claim 1, wherein the first discharging section is different from the second discharging section, and the recording device discharges the medium with the defect and the non-corresponding medium without the cassette specified from the information separately to the first discharging section and the second discharging section.

6. The recording device according to claim 1, further comprising:

a remaining amount detection section configured to detect a remaining amount of medium accommodated in the cassette, wherein the recording device does not transport the medium from the placement tray to the cassette when the remaining amount in the cassette of a transport destination is equal to or greater than a threshold.

7. The recording device according to claim 1, wherein the cassette includes a positioning mechanism including a pair of edge guides configured to position the medium at least in a width direction, and the positioning mechanism includes a power source that moves the pair of edge guides in a positioning direction, and performs an aligning operation in which the pair of edge guides hits both side edges of a bundle of medium transported to the cassette.

8. The recording device according to claim 1, further comprising:

a discard section that includes a shredder connected to the recording device via the second discharge port.

9. The recording device according to claim 1, further comprising:

a discard section that includes a discarding box that collects the medium with defects by discharging the medium with defects from the second discharge port.

* * * * *